US007435521B2

(12) United States Patent
Yagi et al.

(10) Patent No.: US 7,435,521 B2
(45) Date of Patent: Oct. 14, 2008

(54) TONER FOR DEVELOPING ELECTROSTATIC IMAGE

(75) Inventors: Shinichiro Yagi, Shizuoka (JP); Hiroshi Yamada, Shizuoka (JP); Hiroshi Yamashita, Shizuoka (JP); Naohiro Watanabe, Shizuoka (JP); Tsunemi Sugiyama, Shizuoka (JP); Shigeru Emoto, Shizuoka (JP); Masami Tomita, Shizuoka (JP); Toshiki Nanya, Shizuoka (JP); Tadao Takikawa, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/023,110

(22) Filed: Dec. 28, 2004

(65) Prior Publication Data

US 2005/0164114 A1 Jul. 28, 2005

Related U.S. Application Data

(63) Continuation of application No. PCT/JP03/08315, filed on Jun. 30, 2003.

(30) Foreign Application Priority Data

Jun. 28, 2002 (JP) ..... 2002-191289
Jan. 22, 2003 (JP) ..... 2003-014053

(51) Int. Cl.
*G03G 9/087* (2006.01)

(52) U.S. Cl. ..... 430/109.4; 430/108.1; 430/110.1; 430/110.2; 430/110.3; 430/119.88; 430/123.51

(58) Field of Classification Search ..... 430/109.4, 430/110.1, 110.2, 110.3, 137.11, 108.1, 108.22, 430/108.4, 119.88, 119.87, 123.51, 123.54
See application file for complete search history.

(56) References Cited

U.S. PATENT DOCUMENTS

| | | | | |
|---|---|---|---|---|
| 4,996,127 | A * | 2/1991 | Hasegawa et al. | 430/110.1 |
| 5,541,031 | A * | 7/1996 | Yamashita et al. | 430/129 |
| 5,547,802 | A * | 8/1996 | Kawase et al. | 430/108.24 |
| 5,770,342 | A | 6/1998 | Okae et al. | |
| 6,080,519 | A * | 6/2000 | Ishiyama et al. | 430/110.3 |
| 2001/0033982 | A1 * | 10/2001 | Ishikawa et al. | 430/110.1 |
| 2001/0053492 | A1 | 12/2001 | Suwabe et al. | |

(Continued)

FOREIGN PATENT DOCUMENTS

EP 1 205 813 A1 5/2002

(Continued)

OTHER PUBLICATIONS

Diamond, A.S., ed., *Handbook of Imaging Materials*, Marcel Dekker, Inc., NY (1991), p. 165.*

(Continued)

*Primary Examiner*—Janis L Dote
(74) *Attorney, Agent, or Firm*—Oblon, Spivak, McClelland, Maier & Neustadt, P.C.

(57) ABSTRACT

A toner for developing an electrostatic image which has a small particle size essential for attaining a high-quality image, and can output a high-quality image excellent in frictional charging property and free from scumming. The toner for developing an electrostatic image has the volume average particle diameter of 2.0 μm to 7.1 μm and the surface condition of the toner is in scab form.

42 Claims, 5 Drawing Sheets

U.S. PATENT DOCUMENTS

| | | | | |
|---|---|---|---|---|
| 2003/0118366 | A1* | 6/2003 | Nukada et al. | 399/109 |
| 2003/0138717 | A1* | 7/2003 | Yagi et al. | 430/110.4 |
| 2003/0180644 | A1* | 9/2003 | Nanya et al. | 430/108.22 |

FOREIGN PATENT DOCUMENTS

| | | |
|---|---|---|
| JP | 63-104064 | 5/1988 |
| JP | 63-244056 | 10/1988 |
| JP | 05-088409 | 4/1993 |
| JP | 05-119513 | 5/1993 |
| JP | 05-331215 | 12/1993 |
| JP | 05-331216 | 12/1993 |
| JP | 06-332254 | 12/1994 |
| JP | 07-114211 | 5/1995 |
| JP | 2537503 | 7/1996 |
| JP | 09-006044 | 1/1997 |
| JP | 09-127720 | 5/1997 |
| JP | 11-149181 | 6/1999 |
| JP | 11-258850 | 9/1999 |
| JP | 11-327199 | 11/1999 |
| JP | 2000-003064 | 1/2000 |
| JP | 2000-091055 | 3/2000 |
| JP | 2000-292973 | 10/2000 |
| JP | 2000-292978 | 10/2000 |
| JP | 2001-022117 | 1/2001 |
| JP | 2002-082487 | 3/2002 |
| JP | 2002-148848 | 5/2002 |
| JP | 2002-162762 | 6/2002 |
| JP | 2002-169443 | 6/2002 |
| JP | 2002-182427 | 6/2002 |

OTHER PUBLICATIONS

Schaffert,R.M., *Electrophotography*, John Wiley & Sons, NY (1975), pp. 55-56.*

Grant, R., et al., ed., *Grant & Hackh's Chemical Dictionary*, fifth edition, McGraw-Hill Book Co., NY (1987), pp. 232 and 349.*

U.S. Appl. No. 11/289,488, filed Nov. 30, 2005, Shimojo et al.

U.S. Appl. No. 11/313,817, filed Dec. 22, 2005, Inoue, et al.

U.S. Appl. No. 11/487,374, filed Jul. 17, 2006, Yamashita, et al.

U.S. Appl. No. 11/513,175, filed Aug. 31, 2006, Ohki, et al.

U.S. Appl. No. 11/519,893, filed Sep. 13, 2006, Inoue, et al.

U.S. Appl. No. 11/608,521, filed Dec. 8, 2006, Satoru, et al.

U.S. Appl. No. 11/685,872, filed Mar. 14, 2007, Uchinokura, et al.

U.S. Appl. No. 11/687,372, filed Mar. 16, 2007, Yamada, et al.

U.S. Appl. No. 11/685,969, filed Mar. 14, 2007, Uchinokura, et al.

U.S. Appl. No. 11/852,778, filed Sep. 10, 2007, Nagatomo, et al.

U.S. Appl. No. 11/857,791, filed Sep. 19, 2007, Kojima, et al.

U.S. Appl. No. 11/857,999, filed Sep. 19, 2007, Yamashita, et al.

U.S. Appl. No. 12/013,108, filed Jan. 11, 2008, Yagi, et al.

U.S. Appl. No. 12/040,451, filed Feb. 29, 2008, Saitoh, et al.

U.S. Appl. No. 12/050,502, filed Mar. 18, 2008, Yamada, et al.

U.S. Appl. No. 12/046,011, filed Mar. 11, 2008, Nagamoto, et al.

U.S. Appl. No. 12/047,807, filed Mar. 13, 2008, Honda, et al.

* cited by examiner

TONER FOR DEVELOPING ELECTROSTATIC IMAGE

CROSS-REFERENCE TO RELATED APPLICATIONS

This is a continuation of Application No. PCT/JP2003/008315, filed on Jun. 30, 2003.

BACKGROUND OF THE INVENTION

1. Field of the Invention

The present invention relates to a toner for developing an electrostatic image for developing an electrostatic charge image formed on the surface of a photoconductor in electrophotography, electrostatic recording or the like, a developer containing the toner, an image forming method using the toner, a toner container containing the toner, and an image forming apparatus equipped with the toner.

2. Description of the Related Art

In recent years, toners with smaller particle diameters have been actively developed at the strong request of the market for higher image quality, thus toners with an average particle diameter of 7 μm or less are currently on the market. The manufacture of above-described toners with a particle diameter of 7 μm or less requires much cost when using a conventional grinding method. To solve the problem, new pulverizing methods that replace the grinding method have been studied. Examples thereof include the preparation of toners by a suspension polymerization method.

It is a method suitable to obtain a toner that has desirable properties of the toner pulverized in such aqueous media, and has a small particle diameter.

However, toners pulverized in aqueous media have a very smooth surface, which is one of the properties of them. When toner particles have a small diameter and a very smooth surface, they are very difficult to be frictionally charged. Toner particles with a small particle diameter have very poor powder flow ability. In either of the one-component developing apparatus or the two-component developing apparatus, toner particles are frictionally charged while rolling on and contacting with the surface of either a developing roller or carrier particles, thus small-diameter toner particles that have poor powder flowability and a rolling property are hard to be frictionally charged, and thus are regarded as inferior in uniformity. In addition, when the toner particles have a smooth surface, the frictional charging property thereof is further deteriorated.

Although the mechanism has not been accurately elucidated, it is considered that a slip phenomenon occurs between a toner and a frictional charging member, which prevents the toner from obtaining a sufficient quantity of frictional charge. More particularly, it is considered that the smooth surface of the toner inhibits the toner from obtaining appropriate resistance against a toner layer thickness controlling blade used in one-component developing apparatus, or against a carrier used in two-component developing apparatus, thus the toner cannot obtain a sufficient quantity of frictional charge. In addition, when the toner particles are nonuniform in their frictional charge quantity, the frictional charge quantity results in broader distribution. Thus, if a toner could not obtain a sufficient quantity of frictional charge and has a broad distribution of frictional charge quantity, it develops even on a non-image area on a photoconductor, causing scumming.

Conventionally, in electrophotographic apparatuses, electrostatic recording apparatuses or the like, electric or magnetic latent images have been developed by toners. For example in electrophotography, an electrostatic charge image (latent image) is formed on a photoconductor, and the latent image is developed using the toner to thereby form a toner image. The toner image is usually transferred on a transfer material such as paper, and then fixed by heating or other methods.

Toners used for electrostatic charge image developing are generally colored particles in which a binder resin is to contain a colorant, a charge control agent, and other additives. The manufacturing methods are broadly divided into a grinding method and a suspension polymerization method. In the grinding method, a colorant, a charge control agent, an offset preventing agent and other additives are fused and mixed, and homogeneously dispersed in a thermoplastic resin. The resulting composition is ground and classified to obtain a toner. The grinding method can manufacture a toner with rather excellent properties, but the selection of the materials of the toner is limited. For example, compositions obtained by fusing and mixing must be those which can be ground and classified with economically usable apparatuses. According to the requirement, the compositions obtained by fusing and mixing must be adequately fragile. Therefore, when the composition is actually ground to particles, a particle distribution of a broad range tends to be formed. To obtain a copy image with a good resolution and gradation, for example, fine powder with a particle diameter of 5 μm or less and coarse powder with a particle diameter of 20 μm or more must be removed by classification, which significantly decreases the yield of the toner. In addition, under the grinding method, it is difficult to homogeneously disperse the colorant, the charge control agent or the like in a thermoplastic resin. Uneven dispersion of the compounding agents adversely affects the properties of the toner such as flow ability, development property, durability and image quality.

In recent years, to solve these problems in the grinding method, the manufacture of toners by the suspension polymerization method has been suggested and in practice. A technique to manufacture a toner for developing an electrostatic latent image by a polymerization method is known, and actually toners have been manufactured for example by the suspension polymerization method. However, toner particles prepared by the suspension polymerization method are spherical, and thus are inferior in cleanability. In the development and transfer of an object with a low ratio of image area, less residual toner is left and cleaning failure will cause no problem, but on an object with a high ratio of image area such as a photo image, the toner which formed an image that has not been transferred by a certain cause such as paper feeding failure may also occur as transfer residual toner, and accumulation thereof will cause scumming. The residual toner also contaminates a charging roller for contact charging a photoconductor, and inhibit it to deliver its intrinsic charging effect.

Thus, a method for producing toner of indefinite form by associating resin fine particles prepared by an emulsion polymerization method is disclosed (Japanese Patent (JP-B) No. 2537503). However, the toner particles prepared by the emulsion polymerization method have an abundance of residual surfactants not only on the surface but also in the inside of the particle, even after a washing process. This impairs the environmental stability of the toner charge, and broadens the charge distribution to cause a bad scumming on the resulting image. The residual surfactant also contaminates a photoconductor, a charging roller, a developing roller and the like, inhibiting them from delivering their intrinsic charging effect.

In the two-component developing apparatus, a toner is frictionally charged by contacting with a carrier, while in the one-component developing apparatus, the toner is frictionally charged by contacting with a supplying roller for supplying the toner to a developing sleeve, and by contacting with a layer thickness controlling blade for equalizing the toner layer on the developing sleeve. The charging property of the toner is important for the accurate reproduction of an electrostatic charge image on an image carrier such as a photoconductor, thus various kinds of charge control agents and methods to incorporate them into toners have been studied.

Charge control agents which function on the surface of toner particles, because of its high cost, have been attempted to be arranged on the surface of toner particles in a small amount. In Japanese Patent Application Laid-Open (abbreviated to JP-A, hereinafter) Nos. 63-104064, 05-119513, 09-127720 and 11-327199, charge control agents are attached to the surface of toner particles to impart the toner a charging property. However the charging property is insufficient and apts to be separated from the surface, and the manufacture method has not provided a desired charging property. In particular, the method is not intended to consider the initial charging rate of the toner.

JP-A No. 63-244056 describes a method for attaching a charge control agent to the surface of toner particles and fixing it on them using an impact strength occurring between a blade rotating at a high speed, which is referred to as a rotor, and projections fixed on the wall of a container, which are referred to as stator. An inner wall that is not smooth and has projections on it are likely to cause turbulence in a high-velocity airflow, thus it tends to cause excessive grinding of the particles, local fusion on the surface of the particles, embedding of the charge control agent below the surface of the particles, and uneven powder treatment. This seems to be due to the variation in the energy given between particles. More specifically, treatment through such a narrow gap may generate an abundance of heat due to an impact strength in an airflow, which causes the deformation of the toner particles and the progress of the grinding of the toner particles, resulting in the deviation of the average particle diameter and of the particle distribution from the desired ones. Besides, the charge control agent embedded below the surface of the particles might fail to fulfill its function. Regarding actual productivity, the quantity of the treated powder is extremely smaller in comparison with the space for treatment because of the heat generation and excessive grinding of the powder, thus the method is unsuitable to efficient production.

On the other hand, a fixing process by a contact heating method carried out using a heating member such as a heating roller requires the release property of toner particles from the heating member (hereinafter referred to as anti-offset property). The anti-offset property can be improved by arranging a release agent on the surface of toner particles. Regarding this, JP-A Nos. 2000-292973 and 2000-292978 disclose the methods for improving the anti-offset property not only by containing resin fine particles in the inside of toner particles, but also by unevenly distributing the resin fine particles on the surface of the toner particles. However, under these methods, the lower limit of fixing temperature increases, which causes the insufficient low-temperature fixing property or energy-saving fixing property.

However, the preparation of toner particles of indefinite form by associating the resin fine particles obtained by the emulsion polymerization method presents problems as described below.

When the fine particles of a release agent are associated with each other to improve the anti-offset property, the fine particles of the release agent are captured in the toner particles, resulting in the insufficient improvement in the anti-offset property. Since the toner particles are formed of randomly fused resin fine particles, release agent, colorant and other additives; the composition (the content ratio of the components), the molecular weight of the component resin and other properties vary among the obtained toner particles, which results in the difference in the surface properties among the toner particles, making it impossible to form a stable image for a long term. In a low-temperature fixing system that requires the low-temperature fixing property, fixing inhibition is caused by the resin fine particles unevenly distributed on the toner surface, this makes it impossible to secure the width of the fixing temperature.

The first object of the present invention is to provide a toner for developing an electrostatic image which has a small particle diameter essential for attaining a high image quality, is excellent in the frictional charging property, and can output a high quality image free from scumming.

The second object of the present invention is to provide a toner for developing an electrostatic image which can combine a high quality image and a low-temperature fixing property.

The third object of the present invention is to provide a toner for developing an electrostatic image which can provide a high quality image free from scumming, and good cleanability.

The fourth object of the present invention is to provide a toner for developing an electrostatic image which has a sharp charge quantity distribution, is excellent in environmental stability, and can form visible images with a good sharpness over the long term.

The fifth object of the present invention is to provide a developer containing the toner, an image forming method using the toner, a toner container containing the toner, and an image forming apparatus equipped with the toner.

SUMMARY OF THE INVENTION

According to the present invention, a toner for developing an electrostatic image, a developer, an image forming method, a toner container, an image forming apparatus and a one-component developing apparatus as described below are provided.

In a 1st aspect, a toner for developing an electrostatic image including toner particles, wherein the volume average particle diameter of the toner particles is 2.0 to 7.1 μm and the surface condition of the toner is in scab form.

In a 2nd aspect, a toner for developing an electrostatic image according to the 1st aspect, wherein at least a part of surface of the toner is covered with a coat in scab form.

In a 3rd aspect, a toner for developing an electrostatic image according to the 1st aspect, wherein a part of the surface of the toner is covered with a coat in scab form.

In a 4th aspect, a toner for developing an electrostatic image according to the 3rd aspect, wherein the coverage ratio by the coat in scab form is 1 to 90%.

In a 5th aspect, a toner for developing an electrostatic image according to the 3rd aspect, wherein the coverage ratio by the coat in scab form is 5 to 80%.

In a 6th aspect, a toner for developing an electrostatic image according to any of the aspects 2 to 5, wherein the weight ratio of the coat in scab form to the toner is 0.5 to 4.0% by weight.

In a 7th aspect, a toner for developing an electrostatic image according to 6th aspect, wherein the weight ratio of the coat in scab form to the toner is 0.5 to 3.0% by weight.

In an 8th aspect, a toner for developing an electrostatic image according to any of the aspects 1 to 7, wherein the surface condition of the toner in scab form is formed with resin fine particles.

In a 9th aspect, a toner for developing an electrostatic image according to the 8th aspect, wherein the average particle diameter of the resin fine particles is 5 to 2,000 nm.

In a 10th aspect, a toner for developing an electrostatic image according to any of the aspects 1 to 9, further including a charge control agent, wherein the abundance of the charge control agent on the surface of the toner is higher than that in the inside of the toner.

In an 11th aspect, a toner for developing an electrostatic image according to the 10th aspect, wherein the charge control agent is externally added to the surface of toner base particles.

In a 12th aspect, a toner for developing an electrostatic image according to 11th aspect, wherein the external addition of a charge control agent particle to the surface of the toner base particles is carried out by mixing them in a container with a smooth inner surface, wherein a peripheral speed of a rotor is 40 to 150 m/sec.

In a 13th aspect, a toner for developing an electrostatic image according to the 12th aspect, wherein the container with a smooth inner surface is nearly spherical, and the volume of the rotor in the container is half or smaller than the capacity of the container.

In a 14th aspect, a toner for developing an electrostatic image according to any of the aspects 10 to 13, wherein the amount of the charge control agent particle is 0.01% by weight to 2% by weight of the amount of the toner base particles.

In a 15th aspect, a toner for developing an electrostatic image according to any of the aspects 1 to 14, comprising a toner binder resin, wherein the main component of the toner binder resin of the toner is polyester resin.

In a 16th aspect, a toner for developing an electrostatic image according to the 15th aspect, which is prepared by dissolving or dispersing a toner composition which comprises a toner binder resin composed of a modified polyester-base resin (i) capable of reacting with active hydrogen in an organic solvent, allowing the dissolved or dispersed substance to react with at least one of a crosslinking agent and an elongation agent in an aqueous medium containing resin fine particles, removing a solvent from the dispersion, and washing and separating the resin fine particles from the toner surface.

In a 17th aspect, a toner for developing an electrostatic image according to the aspect 15 or 16, wherein the toner binder rein includes an unmodified polyester-base resin (LL) in addition to a modified polyester-base resin (i), and the weight ratio of the modified polyester-base resin (i) to the unmodified polyester-base resin (LL) is 5/95 to 80/20.

In an 18th aspect, a toner for developing an electrostatic image according to any of the aspects 15 to 17, wherein the acid value of the toner binder resin is 1 to 30 mg KOH/g.

In a 19th aspect, a toner for developing an electrostatic image according to any of the aspects 15 to 18, wherein the glass transition temperature of the toner binder resin is 40 to 70° C.

In a 20th aspect, a toner for developing an electrostatic image according to any of the aspects 8 to 19, wherein the resin particle includes at least a kind of resin selected from the group consisting of vinyl resin, polyurethane resin, epoxy resin, and polyester resin.

In a 21st aspect, a toner for developing an electrostatic image according to any of the aspects 16 to 20, wherein the process of removing a solvent from the dispersion is conducted under a reduced-pressure and/or heated condition.

In a 22nd aspect, a toner for developing an electrostatic image according to any of the aspects 16 to 21, wherein the process of removing a solvent from the dispersion is carried out by filtration.

In a 23rd aspect, a toner for developing an electrostatic image according to any of the aspects 1 to 22, wherein the ratio of the volume average particle diameter to the number average particle diameter (Dv/Dn) of the toner particle stands at 1.25 or lower.

In a 24th aspect, a toner for developing an electrostatic image according to any of the aspects 1 to 23, wherein the average circularity of the toner particle is 0.94 to 1.00.

In a 25th aspect, a toner for developing an electrostatic image according to the aspect 24, wherein the average circularity of the toner particle is 0.94 to 0.96.

In a 26th aspect, a toner for developing an electrostatic image including toner particles, wherein the average particle diameter of the toner particles is 2.0 to 7.1 μm, and the ratio of the number of the small projections on the toner surface to the circularity of the toner is 1.0 to 25.0.

In a 27th aspect, a toner for developing an electrostatic image according to the aspect 26, wherein the small projections include resin fine particles.

In a 28th aspect, a toner for developing an electrostatic image according to the aspect 27, wherein the average particle diameter of the resin particle is 5 to 2,000 nm.

In a 29th aspect, a toner for developing an electrostatic image according to any of the aspects 26 to 28, further including a charge control agent, wherein the abundance of the charge control agent on the surface of the toner is higher than that in the inside of the toner.

In a 30th aspect, a toner for developing an electrostatic image according to the 29th aspect, wherein the charge control agent is externally added to the surface of the toner base particles.

In a 31st aspect, a toner for developing an electrostatic image according to the 30th aspect, wherein the external addition of a charge control agent particle to the surface of the toner base particles is carried out by mixing them in a container with a smooth inner surface, wherein a peripheral speed of a rotor is 40 m/sec to 150 m/sec.

In a 32nd aspect, a toner for developing an electrostatic image according to the 31st aspect, wherein the container with a smooth inner surface is nearly spherical, and the volume of the rotor in the container is half or smaller than the capacity of the container.

In a 33rd aspect, a toner for developing an electrostatic image according to any of the aspects 29 to 32, wherein the amount of the charge control agent particle is 0.01% by weight to 2% by weight of the amount of the toner base particles.

In a 34th aspect, a toner for developing an electrostatic image according to any of the aspects 26 to 33, further including a toner binder resin, wherein the main component of the toner binder resin of the toner is polyester resin.

In a 35th aspect, a toner for developing an electrostatic image according to the 34th aspect, which is prepared by dissolving or dispersing a toner composition which includes a toner binder resin composed of a modified polyester-base resin (i) capable of reacting with active hydrogen in an organic solvent, allowing the dissolved or dispersed substance to react with at least one of a crosslinking agent and an elongation agent in an aqueous medium containing resin fine particles, removing a solvent from the dispersion, and washing and separating the resin fine particles from the toner surface.

In a 36th aspect, a toner for developing an electrostatic image according to the aspect 34 or 35, wherein the toner binder includes an unmodified polyester-base resin (LL) in addition to the modified polyester-base resin (i), and the weight ratio between the modified polyester-base resin (i) to the unmodified polyester-base resin (LL) is 5/95 to 80/20.

In a 37th aspect, a toner for developing an electrostatic image according to any of the aspects 34 to 36, wherein the acid value of the toner binder resin is 1 to 30 mg KOH/g.

In a 38th aspect, a toner for developing an electrostatic image according to any of the aspects 34 to 37, wherein the glass transition temperature of the toner binder resin is 40 to 70° C.

In a 39th aspect, a toner for developing an electrostatic image according to any of the aspects 27 to 38, wherein the resin particle includes at least a kind of resin selected from the group consisting of vinyl resin, polyurethane resin, epoxy resin, and polyester resin.

In a 40th aspect, a toner for developing an electrostatic image according to any of the aspects 35 to 39, wherein the process of removing a solvent from the dispersion is conducted under a reduced-pressure and/or heated condition.

In a 41st aspect, a toner for developing an electrostatic image according to any of the aspects 35 to 40, wherein the process of removing a solvent from the dispersion is carried out by filtration.

In a 42nd aspect, a toner for developing an electrostatic image according to any of the aspects 26 to 41, wherein the ratio of the volume average particle diameter to the number average particle diameter (Dv/Dn) of the toner particle is 1.25 or lower.

In a 43rd aspect, a toner for developing an electrostatic image according to any of the aspects 26 to 42, wherein the average circularity of the toner particle is 0.94 to 1.00.

In a 44th aspect, a toner for developing an electrostatic image according to the 43rd aspect, wherein the average circularity of the toner particle is 0.94 to 0.96.

In a 45th aspect, a developer which includes a toner for developing an electrostatic image according to any of the aspects 1 to 44.

In a 46th aspect, an image forming method which uses a toner according to any of the aspects 1 to 44 in a developing apparatus equipped with a toner recycling mechanism.

In a 47th aspect, a toner container which contains a toner according to any of the aspects 1 to 44.

In a 48th aspect, an image forming apparatus equipped with a toner according to any of the aspects 1 to 44, which fixes a toner image on a transfer material by passing it through two rollers for heat fusing, wherein the surface pressure applied between the two rollers (roller load/contact surface) being $1.5\times10^5$ Pa or lower.

In a 49th aspect, a one-component developing apparatus equipped with a toner according to any of the aspects 1 to 44.

In a 50th aspect, a process cartridge which contains a toner for developing an electrostatic image according to any of the aspects 1 to 44.

Further objects, features and advantages of the present invention will become apparent from the following description of the preferred examples with reference to the attached drawings.

DESCRIPTION OF THE PREFERRED EMBODIMENTS

The first toner according to the present invention is characterized in that the toner includes toner particles, the volume average particle diameter Dv of the toner particles is 2.0 to 7.1 μm, and the surface condition of the toner is in scab form.

Figure 5A:
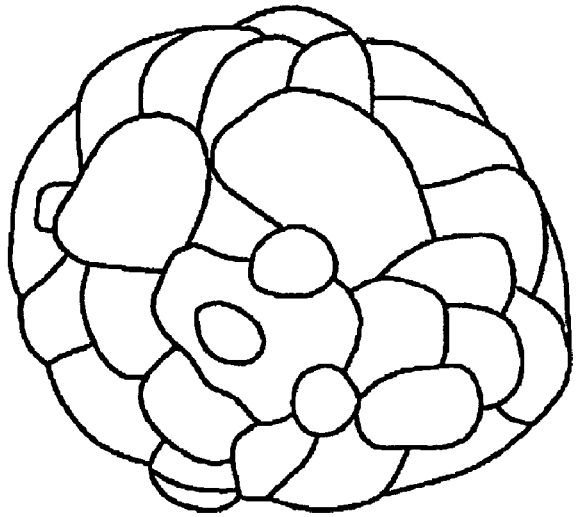
FIG. 5A shows an illustration of the surface of a toner particle in scab form.
Figure 5B:
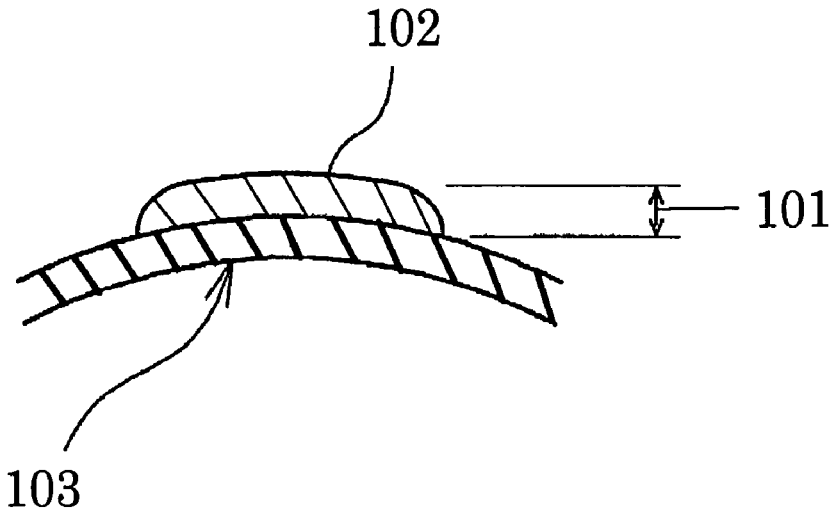
FIG. 5B shows a schematic sectional view of the surface of the toner particle.

It should be noted that the scab form means a condition in which small differences in level 101 are formed by two or more, particularly three scab-like small laminar substances 102 adhering to the surface of the toner 103 (FIGS. 5A and 5B). The difference referred herein is usually a difference in a level of 10 to 80 nm.

The present inventors have found that the frictional charge property of a toner with a volume average particle diameter of 2.0 to 7.1 μm is improved not by smoothing the toner surface but by making it into scab form.

Regarding the toner of the present invention, the surface properties such as small projections on it can be analyzed using an atomic force microscope (AFM). The AFM is served to precisely operate and control either a probe or material in three-dimensional directions using a scanner made of a piezoelectric element, and detect a force between the probe and sample as interaction to thereby obtain an asperity image of the sample surface. While scanning on the sample surface (XY plane) with the probe, the AFM is served to trace the sample surface with performing a feedback control of the distance (the height of the Z axis) between the probe and the sample so as to keep the interaction constantly. In the aspects of the present invention, the surface properties of the toner particles are defined by tracing a square of 1 μm so as to investigate the three-dimensional surface roughness of the surface of the toner particles.

Figure 1:
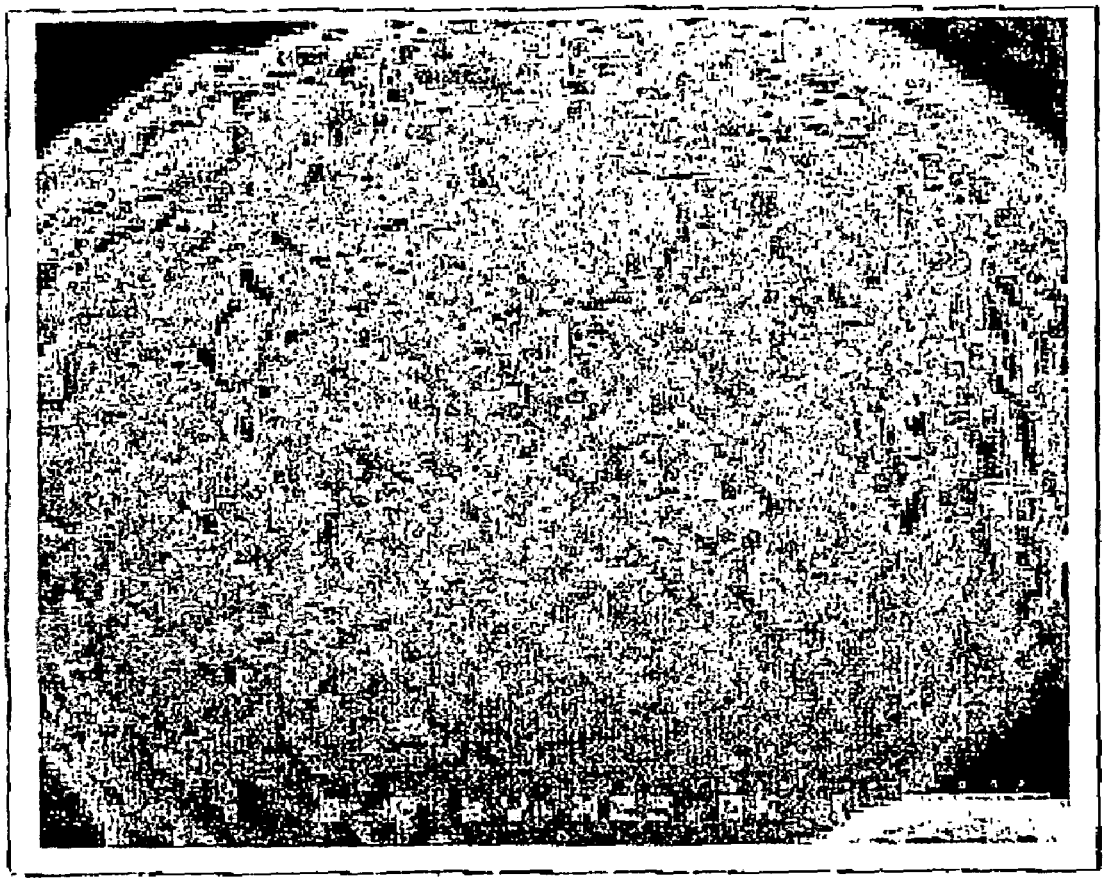
FIG. 1 is a typical drawing of a toner particle with a surface in scab form.

FIG. 1 shows the typical drawing of a toner particle with a surface in scab form.

Although above-described mechanism has not been adequately elucidated, it is considered that the surface of the toner particles pulverized in a conventional aqueous medium is smooth, thus the toner particles can not obtain appropriate frictional resistance, which is essential for attaining frictional charging, against the frictional charging member. On the other hand, the toner of the present invention has a surface in scab form, which may develop an appropriate frictional resistance between the toner particles and the frictional charging member, resulting in a sufficient and uniform frictional charge quantity of the toner particles. With a conventional grinding method, it is difficult to obtain a small diameter toner with a volume average particle diameter of 2.0 to 7.1 μm from the viewpoint of the production cost. Ground toner particles generally don't have a smooth surface due to manufacture method thereof. In addition, they will never have a surface in scab form as described in the present invention. The surface of the ground toner particles is characterized by irregular and large projections. Such toner particles can obtain a sufficient frictional resistance against the frictional charging member, which is aimed in the present invention, but the difference in the surface condition of the toner particles causes the variation in the frictional resistance, resulting in a broad distribution of frictional charge quantity.

A second toner of the present invention is characterized in that the toner includes toner particles, the volume average particle diameter Dv is 2.0 to 7.1 μm, and the ratio between the number of small projections on the surface of the toner particles and the circularity of the toner particles is 1.0 to 25.0.

In the present invention, toner particles have small projections on their surface, and the number of the small projections must be in a specific number in light of the relationship with the circularity of the toner particles.

The small projections specifically refer to projections having a height of 10 to 30 nm, and we have found that the projections of the size are the most suitable for frictional charging. The number of the small projections means the number of projections present in a square of 1 μm on the surface of the toner particles. In the present invention, the ratio between the number of the small projections and the circularity of the toner particles needs to be 1.0 to 25.0. When the ratio between the number of the small projections and the circularity of the toner particles is less than 1.0, the number of the small projections is small despite high circularity, resulting in an insufficient frictional resistance and thus in poor frictional charging. On the other hand, when the ratio between the number of the small projections and the circularity of the toner exceeds 25.0, in addition that the circularity is low and flow ability is poor, there is a large number of small projections that results in too high a frictional resistance, causing the fusion of the toner (component) to the frictional charging member.

The toner of the present invention may preferably be not completely covered with the coat in scab form. When the toner particles are completely covered with the coat in scab form, they will deteriorate in low-temperature fixing property. The cause is considered as follows. When the surface of toner particles is completely covered with a coat in scab form, a wax existing within the toner particles cannot come to the outermost surfaces of the toner particles and fails to release the toner particles from the surface of a fixing means, and thus the low-temperature fixing property is impaired. This suggests that the wax contained in the toner particles requires a passageway to reach the outermost surface of the toner particles.

The surface of the toner of the present invention may preferably be covered with a coat in scab form at a coverage rate of 1 to 90%. When the coverage rate is less than 1%, it is difficult to sufficiently attain the effect of the scab form. In such a case, the toner particles cannot readily obtain an appropriate frictional resistance, which is essential to attain frictional charging, against the frictional charging member and have difficulty in attaining a sufficient frictional charge quantity and uniformity thereof. On the other hand, when the coverage rate exceeds 90%, as aforementioned, the presence of the coat in scab form may inhibit the wax in toner particles from coming to the outermost surface of the particles, resulting in a failure in exhibiting the low-temperature fixing property of the toner. The coverage rate of the surface of toner particles by the coat in scab form may more preferably be 5 to 80%.

In the present invention, the weight ratio of the coat in scab form to a toner particle may preferably be 0.5 to 4.0% by weight. When the weight ratio of the coat in scab form is less than 0.5% by weight, which means less scab form, it is difficult to fully achieve the effect of the scab form. In such a case, toner particles cannot readily obtain an appropriate frictional resistance, which is essential to attain frictional charging, against the frictional charging member, thus have difficulty in attaining a sufficient quantity of frictional charge and uniformity thereof. On the other hand, when the weight ratio of the coat in scab form exceeds 4.0% by weight, the surface of toner particles is likely to be completely covered by the coat in scab form, and as aforementioned, the presence of the coat in scab form inhibits the wax in the toner particles from coming to the outermost surface of the toner particles, resulting in a failure in exhibiting the low-temperature fixing property of the toner. The weight ratio of the coat in scab form to a toner particle may more preferably be 0.5 to 3.0% by weight.

In the present invention, the surface of a toner particle in scab form may preferably be formed by resin fine particles. In the present invention, although means for making the surface condition of a toner particle into scab form are not limited, conveniently used are resin fine particles. More specifically, resin fine particles are attached to the surface of core particles of a toner, and the attached resin fine particles are deformed (thinly spread) with a suitable means, and a plurality of the resin fine particles are coagulated each other to be finally made into scab form. To make the toner surface condition into scab form by this method, it is important to select easily deformed resin fine particles. For example, the average particle diameter of the resin fine particles may preferably be 5 to 2,000 nm. The resin fine particles with a radius of less than 5 nm are not suitable to form a toner particle surface in scab form because such particles are so fine in themselves that they are likely to form an extremely smooth coat. On the other hand, when the average particle diameter of the resin fine particles exceeds 2,000 nm, the particles are so large that it is difficult to deform them, and it becomes difficult to make the toner particle surface into scab form. The average particle diameter of the resin fine particles may more preferably be 20 to 300 nm.

The resin fine particles may have a function to control the properties of toner particles (e.g., circularity, particle distribution), which will be discussed later.

In the present invention, toner particles preferably contain a charge control agent, wherein the abundance ratio of the charge control agent may preferably be higher in proximity of the surface of the toner particles than in the inside the them. It is confirmed that a charge control agent that have not been in proximity of the surface of toner particles hardly contributed to frictional charging property. Therefore, regarding the charge control agents, the highest efficiency of a charge controlling is achieved when the abundance ratio of the charge control agent is higher in proximity of the surface of the toner particles than in the inside of the toner particles. It is not preferred to abundantly use a charge control agent because it generally has a function to reduce the volume specific resistance of toner particles. In this respect, it may be adopted to concentrate the most part of a charge control agent in proximity of the surface of toner particles. The combinational use of the afore-mentioned method and the special surface condition of the toner of the present invention may remarkably improve the frictional charging property of toner particles.

In the present invention, it may be adopted to externally add a charge control agent to the surface of toner base particles as a means to concentrate the charge control agent in proximity of the surface of the toner particles. Although the means to externally add a triboelectrification controlling agent is not limited at all, such a treating method to directly control the amount of the charge control agent is efficient and can be regarded as preferred conditions.

In the present invention, the amount of an externally added charge control agent may preferably be 0.01 to 2% by weight of that of toner base particles. When the amount of an externally added charge control agent is less than 0.01% by weight, the charge control agent is too less to sufficiently improve the frictional charging property of the toner base particles. On the other hand, when the amount of an externally added charge control agent exceeds 2% by weight, the adhesive force of the charge control agent to the toner base particles decreases, and the charge control agent separated from the toner base particles will contaminate various components. This can bring about various adverse influences. As an example, the agent may contaminate a carrier and a toner layer thickness controlling member in the one-component developing apparatus to inhibit them from imparting the frictional charge property to toner particles. If a photoconductor is contaminated, it cannot keep an adequate potential and may cause the deterioration of an image.

The toner base particles are particles after pulverization, and refers to the particles in a condition that no other substances (e.g., charge control agent, external additives) are attached or sticking to their surface.

In the present invention, the main component of the toner binder resin in toner particles may preferably be a polyester resin.

In the present invention, it may be adopted to use a reactive modified polyester resin (RMPE) reactive with active hydrogen. The reactive modified polyester resin (RMPE) includes a polyester prepolymer having an isocyanate group (A). The prepolymers (A) include the reaction products of polyisocyanates (PIC) and polyesters that are the polycondensation products of polyols (PO) and polycarboxylic acids (PC) and contain active hydrogen.

Groups having active hydrogen contained in the polyester include hydroxyl groups (alcoholic hydroxyl group and phenolic hydroxyl group), amino group, carboxyl group, and mercapto group. Among these, the alcoholic hydroxyl group is preferred.

Modified polyester (MPE) such as urea-modified polyester is easy in control of the molecular weight of its polymer components. The MPE thus is advantageous in serving to secure, in particular, the oilless low-temperature fixing properties (a broad range of releasing property and fixing property without release oil application mechanism for fixing heating media) of dry toners. In particular, a polyester prepolymer with a urea-modified terminal can control the adhesiveness to fixing heating media with maintaining the high flowability and transparency of an unmodified polyester resin in the range of fixing temperature.

In the present invention, when an image is formed using the toner of the present invention, fixing may preferably be carried out using a fixing apparatus in which the surface pressure (roller load/contact area) applied between the two rollers is 1.5×105 Pa or lower. Since the toner of the present invention has a surface in scab form, it cannot be closest-packed in the toner layer on a transfer paper, resulting in a thick toner layer. Fixing of such a thick toner layer at a conventional surface pressure will cause the deformation of the toner layer, which results in the disorder of dots and the deterioration of the image quality. In such a case, it is necessary to reduce the surface pressure applied between the two rollers in order to fix the toner layer on the transfer paper in a condition as close to its original state as possible. According to the study by the present inventors, a fixing apparatus with a surface pressure of 1.5×105 Pa or lower causes less deformation of the toner layer (dots) on a transfer paper, and provides a high quality image superior in the dot reproducibility even after fixing. The surface pressure may preferably be 0.2×105 Pa or more. When the pressure is below 0.2×105 Pa, heat energy is not sufficiently transferred to the toner particles forming a toner layer on a transfer paper, which makes it difficult to fix the toner particles. The surface pressure may more preferably be in ranges of 1.0×105 Pa or lower and 0.2×105 Pa or higher. The requirements regarding the surface pressure are not limited to the cases where two rollers are used.

Figure 2:
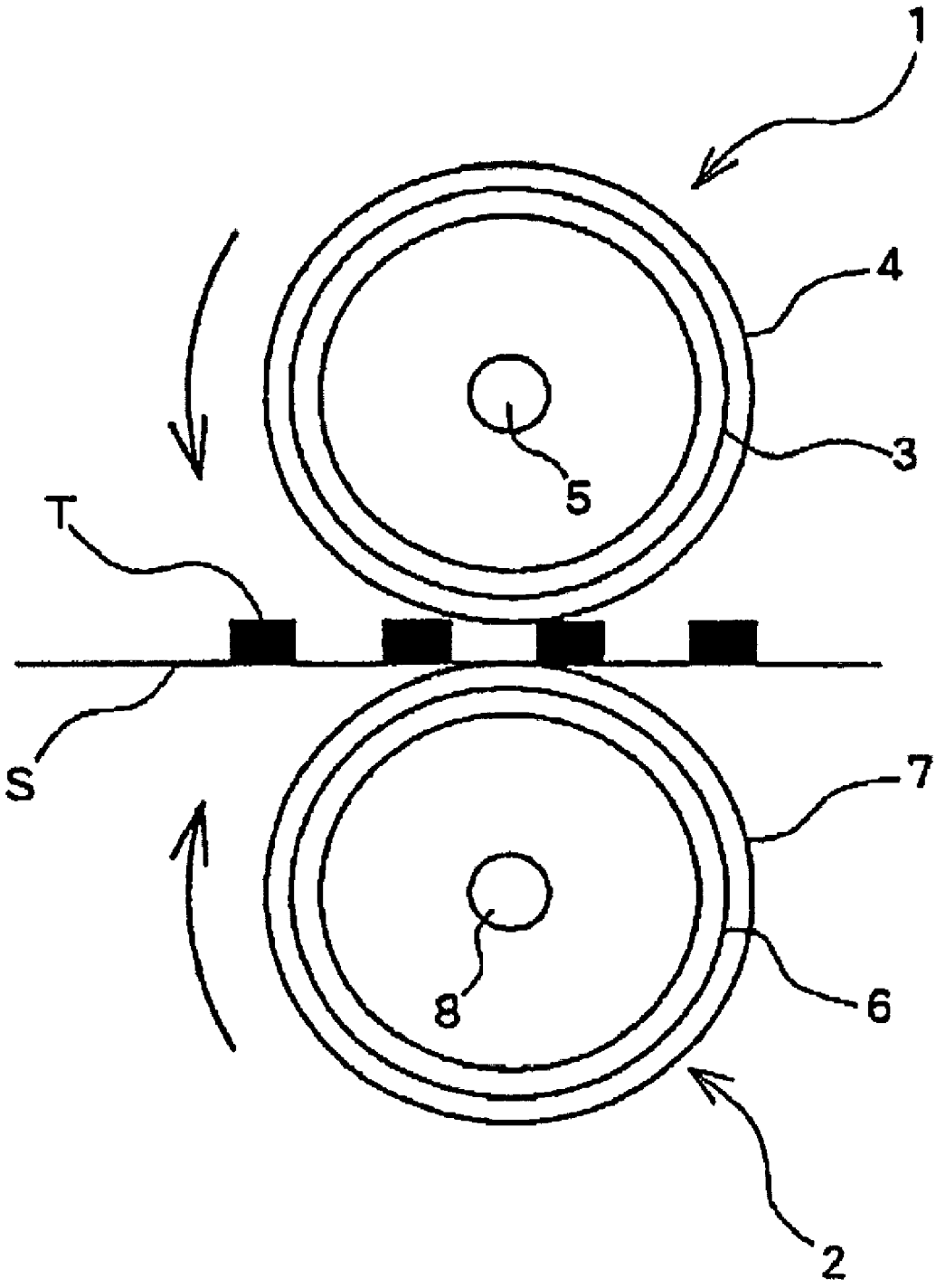
FIG. 2 is a schematic illustration of a fixing apparatus in the image forming apparatus of the present invention.

FIG. 2 shows a schematic illustration of an example of a fixing apparatus used in the present invention.

In FIG. 2, numeral 1 represents a fixing roller, 2 represents a press roll, 3 represents a metal cylinder, 4 represents an anti-offset layer, 5 represents a heating lamp, 6 represents a metal cylinder, 7 represents an anti-offset layer, 8 represents a heating lamp, T represents a toner image, and S represents a support (transfer paper such as paper).

Hereinafter the present invention is further described in detail.

(Weight Ratio of Coat in Scab Form)

The weight ratio of the coat in scab form can be determined as follows: the substances derived not from the toner particles but from the coat in scab form are analyzed with a pyrolysis gas chromatograph mass spectrometer, and the peak area of them is calculated to determine the weight ratio.

The weight ratio of the coat in scab form is expressed by the formula:

$$R=A/B\times 100$$

R: Weight ratio of the coat in scab form
A: Weight of the coat in scab form on toner particles
B: Weight of toner particles (Circularity and Circularity Distribution)

It is important that the toner of the present invention have a specific form and form distribution. If deformed ones with an average circularity of less than 0.94 and far from a round shape, it is hard to obtain an appropriate frictional resistance specific to scab form, which is the surface condition of the toner of the present invention, against a frictional charging member. In addition, deformed toner particles far from a round shape cannot form a high quality image with satisfactory transfer properties and a dust free condition.

In the present invention, the average circularity of the toner particles may preferably be 0.96 or lower. When the average circularity is higher than 0.96, in a system using blade cleaning or the like, cleaning failure is caused on a photoconductor and a transfer belt, which causes a stain on an image. In the development and transfer of an object with a low rate of image area, less residual toner is left in which cleaning failure will cause no problem, while in the development and transfer of an object with a high rate of image area such as a photo image, and a paper feeding failure, a developing toner particles that has not been transferred may occur as a transfer residual toner particles on a photoconductor, and the accumulation of the toner particles will cause background stain. The residual toner particles also contaminate a charging roller for contact charging a photoconductor, which hinders its intrinsic charging effect from being exhibited. It was proved that toner particles with an average circularity of 0.96 to 0.94 are the most effective to form a highly definite image with the reproducibility of appropriate densities. More preferably, the average circularity of the particles is 0.955 to 0.945, and the content of the particles with a circularity of less than 0.94 is 10% or lower.

As a method for measuring the shape of the toner particles, it is appropriate to use a technique using an optical sensing zone, in which a suspension containing the particles is passed through a photographic detection band on a plate, and a CCD camera optically senses and analyze the image of the particles. The average circularity or the particles is a value obtained by dividing the circumference of an equivalent circle by an equal projected area obtained by this technique or the like with the circumference of a real particle. The value is measured as an average circularity using a flow type particle image analyzer FPIA-1000 (manufactured by To a Medical Electronics Co., Ltd.). The specific measuring method is as follows: 0.1 to 0.5 ml of a surfactant, preferably alkylbenzene sulfonates, is added as a dispersant in 100 to 150 ml of water in a container that has been purified of solid impurities, followed by the addition of about 0.1 to 0.5 g of a test sample. The suspension in which the sample has been dispersed is subjected to a dispersion treatment for about one to three minutes in an ultrasonic disperser to make the dispersion concentration 3,000 to 10,000 particle/μl, and the shape and distribution of the toner particles are measured using the apparatus.

[Dv/Dn (the Ratio of the Volume Average Particle Diameter to the Number Average Particle Diameter)]

The toner of the present invention must have a volume average particle diameter of 2 to 7.1 μm to achieve high image quality. When the volume average particle diameter exceeds 7 μm, the content of crude particles increases, making it impossible to form dots at 1,200 dpi or higher. On the other hand, when the volume average particle diameter is less than 2 μm, it becomes difficult to uniformly control the behavior of the respective toner particles in development, transfer and cleaning, resulting in a failure in achieving high image quality. When the volume average particle diameter is smaller than the range as defined in the present invention, in a two-component developer, the toner particles fuse with the surface of a carrier during long-term stirring in a developing apparatus to deteriorate the charging ability of the carrier. When the toner is used in a one-component developer, the particles tend to film a developing roller and fuse with a blade or other members for thinly applying the toner particles, and deprive them of the reliability as an image forming apparatus. These phenomena are similar to toners containing a content of fine particles higher than the range as defined in the present invention. The volume average particle diameter of toner particles may more preferably be 3 to 6 μm.

For the toner of the present invention, the ratio between the volume average particle diameter (Dv) and the number average particle diameter (Dn) may preferably be 1.25 or lower. In a two-component developer, even if toner particles are inputted and outputted for a long term, the variation in the toner particle diameter in the developer is small, and good and stable developing properties are attained even during a long-term stirring in a developing apparatus. When used in a one-component developer, even if the toner particles are inputted and outputted, the variation in the toner particle diameter is small, and the filming of a developing roller by the toner particles and the fusion of the toner particles with a blade or other members for thinly applying the toner particles does not occur, and good and stable developing properties and images are attained.

On the other hand, when the particle diameter of toner particles is larger than the range as defined in the present invention, it becomes difficult to attain a high-resolution and high quality image, and the variation in the particle diameter of the toner particles is likely to be large when the toner in a developer is inputted and outputted. This is similar to the cases where the ratio of the volume average particle diameter to the number average particle diameter is more than 1.25.

When the ratio of the volume average particle diameter to the number average particle diameter is less than 1.10, the particles have a substantially uniform diameter, and completely uniformly behave during developing, transfer and cleaning, and continuously attain a highest image quality even in cases where the toner is inputted and outputted for a long term due to no variation in the aforementioned behavior of the toner particles.

[Polyester Resin (PE)]

Polyester resins (PE) are obtained from the polycondensation products of polyols (PO) and polycarboxylic acids (PC).

Polyols (PO) include diols (DIO) and polyols having a valency of three or more (TO), and DIO alone and a mixture of DIO and a small amount of TO may be adopted.

Diols include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol, hydrogenate bisphenol A); bisphenols (e.g., bisphenol A, bisphenol F, bisphenol S); the adducts of alicyclic diols with alkylene oxide (e.g., ethylene oxide, propylene oxide and butylene oxide), and the adducts of bisphenols with alkylene oxide (e.g., ethylene oxide, propylene oxide and butylene oxide). Of these, alkylene glycols with a carbon number of 2 to 12 and adducts of bisphenols with alkylene oxide may be adopted. Adducts of bisphenols with alkylene oxide and combinations of an adduct of bisphenol with an alkylene oxide and an alkylene glycol with a carbon number of 2 to 12 are preferably adopted.

Polyols with a valency of three or more (TO) include polyvalent aliphatic alcohols with a valency of three to eight (e.g., glycerol, trimethyrol ethane, trimethyrol propane, pentaerythritol and sorbitol); phenols with a valency of three or more (e.g., trisphenol PA, phenol novolac and cresol novolac); and the adducts of polyphenols with alkylene oxide with a valency of three or more.

Polycarboxylic acids (PC) include dicarboxylic acids (DIC) and polycarboxylic acids with a valency of three or more (TC), and DIC alone and a mixture of DIC and a small amount of TC may be adopted.

Dicarboxylic acids include alkylene dicarboxylic acids (e.g., succinic acid, adipic acid and sebacic acid); alkenylene dicarboxylic acids (e.g., maleic acid, fumaric acid); aromatic dicarboxylic acids (e.g., phthalic acid, isophthalic acid, terephthalic acid and naphthalene dicarboxylic acid). Of these, alkenylene dicarboxylic acid with a carbon number of 4 to 20 and aromatic dicarboxylic acid with a carbon number of 8 to 20 may be adopted.

Polycarboxylic acids with a valency of three or more include aromatic polycarboxylic acids with a carbon number of 9 to 20 (e.g., trimellitic acid, pyromellitic acid).

Polycarboxylic acids may be formed by reacting an anhydride of the aforementioned substances or a lower alkyl ester (e.g., methyl ester, ethyl ester and isopropyl ester) with a polyol.

The ratio between polyol (PO) and polycarboxylic acid (PC) is usually 2/1 to 1/1, preferably 1.5/1 to 1/1, and more preferably 1.3/1 to 1.02/1 as an equivalent ratio between hydroxyl groups [OH] and carboxylic groups [COOH].

The peak molecular weight of PE is usually 1,000 to 30,000, preferably 1,500 to 10,000, and more preferably 2,000 to 8,000. Below 1,000, the heat-resistant preservability deteriorates, and above 10,000, the low-temperature fixing property deteriorates. The hydroxyl group value of PE may preferably be 5 or higher, more preferably 10 to 120, and particularly preferably 20 to 80. Below 5, it becomes difficult to satisfy the heat-resistant preservability and the low-temperature fixing property at the same time. The acid value of PE is usually 1 to 30, and preferably 5 to 20. PE with a certain acid value tends to be negatively charged.

[Modified Polyester Resin (MPE) Reactive with Active Hydrogen (i)]

Reactive modified polyester resins (RMPE) reactive with active hydrogen include polyester prepolymers having an isocyanate group (A), and as the prepolymers (A) exemplified are reaction products of polyesters having active hydrogen and polyisocyanates (PIC).

Polyisocyanates (PIC) include aliphatic polyisocyanates (e.g., tetramethylene diisocyanate, hexamethylene diisocyanate and 2,6-diisocyanate methyl caproate); alicyclic polyisocyanates (e.g., isophorone diisocyanate, cyclohexyl methane diisocyanate); aromatic diisocyanates (e.g., tolylene diisocyanate, diphenylmethane diisocyanate); aromatic aliphatic diisocyanates (e.g., α, α, α', α'-tetramethyl xylylene diisocyanate); isocyanurates; the polyisocyanates blocked by a phenol derivative, oxime, caprolactam, and others; and the combination of two or more of them.

The ratio of polyisocyanates (PIC) is usually 5/1 to 1/1, preferably 4/1 to 1.2/1, and more preferably 2.5/1 to 1.5/1 as an equivalent ratio [NCO]/[OH] between isocyanate groups [NCO] and hydroxyl groups [OH] of a polyester having a hydroxyl group. When the ratio [NCO]/[OH] exceeds 5, the low-temperature fixing property deteriorates. When the molar ratio of [NCO] is less than 1, for example in urea-modified polyester, the content of urea in the polyester decreases, resulting in the deterioration of the anti-hot offset property. The content of the polyisocyanate (PIC) component in a polyester prepolymer having an isocyanate group at its terminal (A) is usually 0.5 to 40% by weight, preferably 1 to 30% by weight, and more preferably 2 to 20%. Below 0.5% by weight, the anti-hot offset property deteriorates, and the combination of the heat-resistant preservability and the low-temperature fixing property becomes difficult. Above 40% by weight, the low-temperature fixing property deteriorates.

The number of isocyanate groups contained in one molecule of polyester prepolymers having an isocyanate group at its terminal (A) is usually 1 or more, preferably 1.5 to 3 in average, and more preferably 1.8 to 2.5 in average. When the number is less than 1 per molecule, the molecular weight of the modified polyesters decreases, and the anti-hot offset property deteriorates.

Urea-modified polyesters preferably used as a toner binder resin in the present invention can be produced by the reaction between an amine (B) and the polyester prepolymer having an isocyanate group at its terminal (A).

Amines (B) include diamines (B1), polyamines with a valency of 3 or more (B2), amino alcohols (B3), aminomercaptans (B4), amino acids (B5), and B1 to B5 with blocked amino groups (B6).

Diamines (B1) include aromatic diamines (e.g., phenylene diamine, diethyl toluenediamine and 4,4' diaminodiphenylmethane); alicyclic diamines (e.g., 4,4'-diamino-3,3-dimethyl dicyclohexyl methane, diamine cyclohexane and isophorone diamine); and aliphatic diamines (e.g., ethylene diamine, tetramethylene diamine and hexamethylene diamine).

Polyamines with a valency of three or more (B2) include diethylene toriamine and triethylene tetramine. Amino alcohols (B3) include ethanol amine and hydroxyethyl aniline. Aminomercaptans (B4) include aminoethyl mercaptan and aminopropyl mercaptan. Amino acids (B5) include aminopropionic acid and aminocapronic acid. B1 to B5 with blocked amino groups (B6) include ketimine compounds and oxazoline compounds obtained from the amino acids B1 to B5 and ketones (e.g., acetone, methylethyl ketone and methylisobutyl ketone). Of these amines (B), B1 and a mixture of B1 and a small amount of B2 may be adopted.

In addition, the molecular weight of modified polyesters such as urea-modified polyesters can be controlled using an elongation stopping agent. The elongation stopping agents include monoamine (e.g., diethylamine, dibutyl amine, butyl amine and lauryl amine), and blocked compounds thereof (ketimine compounds).

The ratio of amines (B) is usually 1/2 to 2/1, preferably 1.5/1 to 1/1.5, and more preferably 1.2/1 to 1/1.2 as the equivalent ratio [NCO]/[NHx] between the isocyanate groups [NCO] in a prepolymer having an isocyanate group (A) and the amino groups [NHx] in the amines (B). When the ratio [NCO]/[NHx] exceeds 2 or is lower than 1/2, the molecular weight of modified polyesters such as urea-modified polyesters (UMPE) decreases, resulting in the deterioration in the anti-hot offset property. In the present invention, polyesters modified by a urea bond (UMPE) may contain an urethan bond in addition to urea bond. The molar ratio between the urea bond content and urethane bond content is usually 100/0 to 10/90, preferably 80/20 to 20/80, and more preferably 60/40 to 30/70. When the molar ratio of the urea bond is less than 10%, the anti-hot offset property deteriorates.

As a crosslinking agent and an elongation agent for modified polyesters used in the present invention, active hydrogen compounds capable of reacting with reactive groups such as isocyanate groups, and preferably the amines (B) may be adopted.

Modified polyesters such as urea-modified polyesters (UMPE) used as a toner binder resin in the present invention are produced by a one-shot method and prepolymer method. The weight average molecular weight of modified polyesters such as urea-modified polyesters is usually 10,000 or more, preferably 20,000 to 10,000,000, and more preferably 30,000 to 1,000,000. Below 10,000, the anti-hot offset property deteriorates. The number average molecular weight of the modified polyesters such as urea-modified polyesters are not particularly limited when using unmodified polyesters (PE) (LL), which will be described later, and may be the number average molecular weight serving to facilitate the attainment of the weight average molecular weight. When a modified polyester is used alone, the number average molecular weight thereof is usually 20,000 or less, preferably 1,000 to 10,000, and more preferably 2,000 to 8,000. Above 20,000, the low-temperature fixing property and brightness when used in a full color apparatus deteriorate.

[Combination with Unmodified Polyesters (PE) (LL)]

In the present invention, the modified polyesters (MPE) (i) may be used alone, or in combination with an unmodified polyester (PE) (LL) as a component of a toner binder resin. The combination with a PE is more preferred than the single use because the combination improves the low-temperature fixing property and the brightness when used in a full color apparatus. The resins (PE) (LL) include polycondensation products of polyols (PO) and polycarboxylic acids (PC), which are used in modified polyester resins (i) such as the UMPE, and preferred examples are similar to the modified polyester resins (i). The resins (PE) (LL) may include not only unmodified polyester resins but also those modified by a chemical bond other than urea bond, for example those modified by an urethane bond. MPE and PE are preferably partially dissolved in each other to demonstrate the low-temperature fixing property and the anti-hot offset property. Thus, the polyester component of MPE and PE preferably has a similar composition. When PE is contained, the weight ratio between MPE and PE is usually 5/95 to 80/20, preferably 5/95 to 30/70, more preferably 5/95 to 25/75, and particularly preferably 7/93 to 20/80. When the weight ratio of MPE is less than 5%, the combination of the heat-resistant preservability and the low-temperature fixing property becomes more difficult with the deterioration in the anti-hot offset property.

In the present invention, the glass transition temperature (Tg) of the toner binder resin is usually 40 to 70° C., and preferably 45 to 65° C. Below 40° C., the heat-resistant preservability of the toner deteriorates, and above 70° C., the low-temperature fixing property becomes insufficient. By coexisting with an unmodified polyester resin, the dry process toner of the present invention, even those having a low glass transition temperature, offers better heat-resistant preservability in comparison with known polyester toners. Such a phenomenon is due to that the toner takes an inclined structure. The inclined structure means that the composition or properties of toner particles continuously or gradually vary from the inside to the surface of them. In such toner particles, it was confirmed that the hardness of the toner particles gradually increases from the inside to the surface of them. In other words, the inside of the toner particles has heat properties suitable to low-temperature fixing property, while the surface of the particles has a hardness to such an extent to have a heat resistance.

The temperature (TG') that makes the storage elastic modulus of a toner binder resin 10,000 dyne/cm$^2$ at a measured frequency of 20 Hz is usually 100° C. or higher, and preferably 110 to 200° C. Below 100° C., the anti-hot offset property deteriorates. The temperature (Tη) that makes the viscosity of a toner binder 1,000 poise at a measured frequency of 20 Hz is usually 180° C. or lower, and preferably 90 to 160° C. Above 180° C., the low-temperature fixing property deteriorates. More specifically, TG' may preferably be higher than Tη in light of the combination of the low-temperature fixing property and the anti-hot offset property. In other words, the difference between TG' and Tη (TG'−Tη) may preferably be 0° C. or more, more preferably 10° C. or more, and particularly preferably 20° C. or more. The upper limit of the difference is not particularly limited. In light of the combination of the heat-resistant preservability and the low-temperature fixing property, the difference between TG' and Tη may preferably be 0 to 100° C., more preferably 10 to 90° C., and particularly preferably 20 to 80° C.

(Colorant)

All known dyes and pigments can be used as colorants used in the present invention. Such colorants include carbon black, nigrosine dye, iron black, naphthol yellow S, Hansa yellow (10G, 5G, G), cadmium yellow, yellow iron oxide, loess, chrome yellow, titanellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, iron red, minium, lead vermillion, cadmium red, cadmium mercury red, antimony vermillion, permanent red 4R, para red, fire red, p-chloroorthonitroaniline red, lithol fast scarlet G, brilliant fast scarlet, brilliant carmine BS, permenent red (F2R, F4R, FRL, FRLL, F4RH), fast scarlet VD, vulcan fast rubine B, brilliant scarlet G, lithol rubine GX, permanent red F5R, brilliant carmine 6B, pigment scarlet 3B, Bordeaux 5B, toluidine maroon, permanent Bordeaux F2K, helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, Victoria blue lake, organic phthalocyanine blue, phthalocyanine blue, fast sky blue, indanthrene blue (RS, BC), indigo, ultramarine blue, iron blue, anthraquinone blue, fast violet B, methyl violet lake, cobalt purple, manganese purple, dioxane violet, anthraquinone violet, chrome green, zinc green, chromium oxide, piridian, emerald green, pigment green B, naphthol green B, green gold, acid green lake, malachite green lake, phthalocyanine green, anthraquinone green, titanium oxide, zinc oxide, lithopone, and mixtures thereof.

The content of colorants is usually 1 to 15% by weight of a toner, preferably 3 to 10% by weight.

The colorants used in the present invention may be combined with a resin to be used as a materbatch. Binder resins used to produce the masterbatch or kneaded with the masterbatch include aforementioned modified or unmodified polyester resins, polymers of styrenes such as polystyrene, poly p-chlorostyrene, and polyvinyltoluene and their substituted products; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleate copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic resin, rhodine, modified rhodine, terpene resin, aliphatic or alicyclic hydrocarbon resin, aromatic petroleum resin, chlorinated paraffin, and paraffin wax, they may be used alone or as a combination of two or more of them.

The masterbatch can be obtained by mixing and kneading resins and colorants for materbatch with a high shearing force. At the time, organic solvents may be used to enhance the interaction between the colorants and resins. A so-called flushing method is also preferably used, wherein an aqueous paste containing the water of a colorant is mixed and kneaded with a resin and organic solvent to transfer the colorant to the resin, and the water and organic solvent component are removed, because the wet cake of the colorant can be used as it is without necessitating drying. For the mixing and kneading, a high-shear dispersing apparatus such as a three-roll mill may preferably be used.

(Release Agent)

The toner of the present invention may contain a wax in addition to a toner binder resin and a colorant. Known waxes can be used as the wax used in the present invention. Such waxes include polyolefin waxes (e.g., polyethylene wax, polypropylene wax); long chain hydrocarbons (e.g., paraffin wax, sasol wax); and carbonyl group-containing waxes. Of these, carbonyl group-containing waxes may be adopted. Carbonyl group-containing waxes include polyalkane acid esters (e.g., carnauba wax, montan wax, trimethylol propane tribehenate, pentaerythritol tetrabehenate, pentaerythritol diacetatebehenate, glycerol tribehenate and 1,18-octadecanediol distearate); polyalkanol esters (e.g., trimellitic acid tristearyl and distearyl maleate); polyalkanic acid amides (e.g., ethylenediamine dibehenylamide); polyalkylamides (e.g., trimellitic tristearylamides); and dialkyl ketones (e.g., distearyl ketone). Of these carbonyl group-containing waxes, polyalkane acid esters may be adopted.

The melting point of the wax used in the present invention is usually 40 to 160° C., preferably 50 to 120° C., and more preferably 60 to 90° C. Waxes with a melting point below 40° C. adversely affect the heat-resistant preservability, and waxes with a melting point above 160° C. tend to cause cold offset during fixing at a low temperature. The melting viscosity of the wax may preferably be 5 to 1,000 cps, and more preferably 10 to 100 cps as a measured value at a temperature 20° C. higher than the melting point.

Waxes with a melting viscosity of 1,000 cps are insufficiently effective in improving the anti-hot offset property and low-temperature fixing property.

The content of the wax in toner particles is usually 0 to 40% by weight, and preferably 3 to 30% by weight. Plural kinds of waxes may used in combination.

(Charge Control Agent)

The toner of the present invention preferably contains a charge control agent on the surface of the particles, and the charge control agent may preferably be present only on the surface of the particles.

All known charge control agents may be used. Examples thereof include nigrosine dyes, triphenylmethane dyes, chrome-containing metal complex dyes, molybdic acid chelate pigments, rhodamine dyes, alkoxy amines, quatemary ammonium (including fluorine-modified quatemary ammonium), alkylamide, phosphorus element and compounds thereof, tungsten element and compounds thereof, fluorocarbon activators, metallic salicylates, and metallic salts of salicylic acid derivatives. More specifically, BONTRON 03 that is a nigrosine dye, BONTRON P-51 that is a quatemary ammonium, BONTRON S-34 that is a metal-containing azo dye, E-82 that is an oxynaphthoic acid metal complex, E-84 that is a salicylic acid metal complex, TN-105, E-89 that is a phenol condensation product (the above are manufactured by Orient Chemical Industries Ltd.), TP-302 that is a quatemary ammonium molybdenum complex, TP-415 (the above are manufactured by Hodogaya Chemical Co., Ltd.), COPY CHARGE PSY VP 2038 that is a quaternary ammonium, COPY BLUE PR that is a triphenyl methane derivative, COPY CHARGE NEG VP 2036 that is a quatemary animonium, and COPY CHARGE NX VP 434 (the above are manufactured by Hoechst Co., Ltd., LRA-901, LR-147 that is a boron complex (manufactured by Japan Carlit Co., Ltd.), copper phthalocyanine, perylene, quinacridon, azo pigments, and other polymer compounds having a functional group such as sulfonic group, carboxyl group, and quaternary ammonium salt.

In the present invention, the usage of the charge control agent is determined by the kind of binder resin, the presence or absence of additives used as needed, and the toner manufacturing method including the dispersing method, and not uniquely limited. When the charge control agent is contained in the whole body (inside) of the toner particles, it is used in a range of 0.1 to 10 parts by weight, preferably 0.2 to 5 parts by weight in total, to 100 parts by weight of the binder resin. Above 10 parts by weight, the charging property of the toner becomes so high that the effect of the main charge control agent is depressed, which increases the electrostatic suction force of a developing roller to cause the deterioration in the flowability of the developer and in the density of the resulting image.

These charge control agents may be dissolved and dispersed after they are fused and kneaded with a masterbatch and a resin, or of course may be directly dissolved and dispersed in an organic solvent.

In the present invention, the charge control agent is externally added to the surface of the toner particles as follows: a mechanical impact strength is applied to toner base particles and the charge control agent to fix the charge controlling particles on the surface of the obtained dried toner powers (referred to as base particles), and thereby the agent is fixed and fused on the surface of the base particles to prevent the agent from separating from the surface.

Specific means thereof include a method to apply an impact strength to the mixture with a blade rotating at a high speed, and a method in which the mixture is put in high-velocity airflow, and the particles or combined particles accelerated therein are smashed against a suitable collision plate. Such apparatuses include an Angmill (manufactured by Hosokawa Micron Corporation), an I-type mill (manufactured by Nippon Pneumatic MFG, Co., Ltd.) modified to decrease its crushing air pressure, a Hybridization System (manufactured by Nara Machinery Co., Ltd.), Kryptoron System (manufactured by Kawasaki Heavy Industries, Ltd.), and an automatic mortar. As the stirring treatment apparatus for imparting charging properties in the manufacturing method of the present invention, a container having no fixing members projecting from the inner wall of the container may be adopted, and a container, in which no projection is present on the inner wall of the container arranged around the body of rotation, no asperity is present on the inner wall, and no gap is formed between the body of rotation and the projecting member, may be adopted. The height of the projecting member from the inner wall of the container may preferably be 1 mm or less, and more preferably 0.5 mm or less. By flowing the powder on such a smooth inner wall at a high speed, the surface of the colored particles is homogeneously treated without advancing further grinding of the particles. If the inner wall is not smooth due to the projections thereon, it is likely to generate a turbulent flow in a high-velocity airflow, which tends to cause the excessive grinding of the particles, the local fusion of the particle surface, the immersion of the charge control agent in the surface, and the lack of the uniformity in the treatment of the powder (variation in energy given to the particles). The projecting member from the inner wall of the container as referred to by the present invention does not include, for example, a sensor for measuring the internal temperature and a member projecting from the inner wall in the direction of the axis of the body of rotation for preventing the powder from adhering to the inner wall.

The treatment container may more preferably be a container that is nearly spherical without a cylindrical and plane inner wall, and has a continuous curved surface. Except for such a continuous curved surface, no powder exhausting apparatus, exhaust port or the like are included. Such a continuous curved surface produces a stable high-velocity airflow free from turbulence, and produces the uniformity in the energy given to the particles containing the colorant and resin to be treated. Suitable examples include Q-type Mixer (manufactured by Mitsui Mining Co., Ltd.).

The surface treatment method for the toner of the present invention is as follows: the particles of the charge control agent and those containing the colorant and resin are treated in the treating apparatus, and the surface treatment is carried out for several seconds to several tens of minutes at preferably 40 to 150 m/sec, and more preferably 60 to 120 m/sec. This surface treatment may be repeated several to several tens of times. If the particles are strongly aggregated each other, the treatment may be carried out after treating only the particles containing the colorant and resin at a peripheral speed of several tens m/sec to increase their flowability. Under such conditions, it is considered that the charge control agent is more atomized to further penetrate into the surface of the base particles. The state of the charge control agent cannot be observed with an electron microscope, thus the presence of the charge control agent on the surface is analyzed with an XPS in order to confirm the presence of the input of the charge control agent.

The state of the fixing is assessed by measuring the specific surface area for the base particles and the charge control agent after the surface treatment. In comparison with the specific surface area of the base particles, the specific surface of the charge control agent is larger when the agent is attached to the surface of the base particles, the specific surface area of the charge control agent decreases with the advancement of the fixing, and when the agent is completely immersed in the base particles, the specific surface area of the fixed agent and the base particles becomes equal to each other. The charge control agent is judged as being fixed when the difference in the specific surface area of the agent and the base particles falls within 10%. At the time, the externally added charge control agent is a particle of 1/10 or less the base particles of the present invention, and the added amount is 0.01 to 2.0% by weight of the base particles.

(Resin Fine Particles)

If the resin fine particles used in the present invention are to be added during the manufacturing process to control the shape of the toner particles, the resin may preferably be a resin capable of forming aqueous dispersions, and may be a thermoplastic resin or a thermosetting resin. Examples of these include vinyl resins, polyurethane resins, epoxy resins, polyester resins, polyamide resins, polyimide resins, silicon resins, phenol resins, melamine resins, urea resins, aniline resins, ionomer resins, and polycarbonate resins. As the resin fine particles, the resins may be used in a combination of two or more of them. Of these, vinyl resins, polyurethane resins, epoxy resins, polyester resins, and combination resins of them may be adopted because the aqueous dispersions of fine spherical resin fine particles are readily formed.

Vinyl resins include the homopolymers or copolymers of vinyl monomers such as styrene-(meta)acrylic ester resin, styrene-butadiene copolymer, (meta)acrylic acid-acrylate copolymer, styrene-acrylonitrile copolymer, styrene-maleic anhydride copolymer, and styrene-(meta)acrylic acid copolymer.

(External Additive)

As the additive to help the flowability, developing property, charging property and cleanability of the colored particles obtained in the present invention, inorganic fine particles may be preferably used. The primary particle diameter of the inorganic fine particles may preferably be 5 mμ to 2 μm, and more preferably 5 mμ to 500 mμ. The specific surface area by the BET method may preferably be 20 to 500 $m^2/g$. The usage ratio of the inorganic fine particles may preferably be 0.01 to 5% by weight of the toner, and more preferably 0.01 to 2.0% by weight.

Specific examples of the inorganic fine particles include silica, alumina, titanium oxide, barium titanate, magnesium titanate, calcium titanate, strontium titanate, zinc oxide, tin oxide, silica sand, clay, mica, wollastonite, diatom earth, chromium oxide, ceric oxide, iron red, antimony trioxide, magnesium oxide, zirconium oxide, barium sulfate, barium carbonate, calcium carbonate, silicon carbide, and silicon nitride.

It also includes macromolecular particles such as the particles of the copolymer of polystyrene, methacrylate, and acrylate obtained by soap-free emulsion polymerization, suspension polymerization or dispersion polymerization, and polymeric particles of polycondensed thermosetting resins such as silicone, benzoguanamine, and nylon.

These external additives may be surface-treated to increase their hydrophobicity for preventing the deterioration in flowing property and charging property even under high humidities. Preferred surface treating agents include silane coupling agents, sililation reagents, silane coupling agents having a fluoroalkyl group, organic titanate coupling agents, aluminum coupling agents, silicon oil, and modified silicon oils. Silicon oils and other surface treating agents are particularly effective to modify and maintain the surface properties of a photoconductor because their components are applied on the surface of the photoconductor.

To remove the developer after transfer that remains on a photoconductor or a primary transfer medium, it may be preferred to add a cleanability improving agent. The cleanability improving agent includes fatty acid metal salts such as zinc stearate, calcium stearate, and stearic acid, and polymer fine particles produced by soap-free emulsion polymerization such as polymethyl methacrylate fine particles and polystyrene fine particles. The polymer fine particles may preferably have a relatively narrow particle distribution, and a volume average particle diameter of 0.01 to 1 μm.

(Manufacturing Method)

The toner binder resin can be manufactured by the following method or the like.

A polyol (PO) and a polycarboxylic acid (PC) are heated at 150 to 280° C. in the presence of a known esterification catalyst such as tetrabutoxy titanate and dibutyl tin oxide, formed water is removed, under vacuum as necessary, and polyester having a hydroxyl group is obtained. Then, the product is allowed to react with polyisocyanate (PIC) at 40 to 140° C. to obtain a prepolymer having an icosyanate group (A). The prepolymer (A) is further allowed to react with an amine (B) at 0 to 140° C. to obtain urea-modified polyester. In the reaction of PIC and the reaction between (A) and (B), a solvent may be adopted as needed. Usable solvents include those inactive to isocyanates, such as aromatic solvents (e.g., toluene, xylene); ketones (e.g., acetone, methylethyl ketone, methylisobutyl ketone); esters (e.g., ethyl acetate); amides (e.g., dimethylformamide, dimethylacetamide); and ethers (e.g., tetrahydrofuran). When a polyester (PE) that is not modified with a urea bond is additionally used, the PE is manufactured in the same manner as the polyester having a hydroxyl group, and the PE is dissolved and mixed in a solution of the UMPE after the completion of the reaction.

A toner obtained by dissolving or dispersing a toner composition containing a toner binder resin composed of a modified polyester resin reactive with active hydrogen in an organic solvent, and allowing the dissolved or dispersed product to react with a crosslinking agent and/or an elongation agent in an aqueous medium containing resin fine particles, removing the solvent from the resultant dispersion, and washing and separating the resin fine particles from the toner surface can be manufactured by the following method, but of course the manufacturing method is not limited to them.

(Organic Solvent)

Organic solvents that can be used in the present invention include those inactive to the polyisocyanate (PIC) and others, such as aromatic solvents (e.g., toluene, xylene), ketones (e.g., acetone, methylethyl ketone and methylisobutyl ketone), esters (e.g., ethyl acetate), amides (e.g., dimethylformamide, dimethylacetamide); and ethers (e.g., tetrahydrofuran).

(Method for Forming Toner in Aqueous Medium)

The aqueous medium used in the present invention may be water alone, or may be a combination of water and a solvent miscible with water. The miscible solvents include alcohols (e.g., methanol, isopropanol and ethylene glycol), dimethylformamide, tetrahydrofuran, cellosolves (e.g., methyl cellosolve), and lower ketones (e.g., acetone, methylethyl ketone).

The toner particles may be formed by allowing a dispersion comprised of a polyester prepolymer (A) having an isocyanate group to react with amine (B) in an aqueous medium, or may be formed by allowing it to react with a previously prepared modified polyester such as urea-modified polyester. The method to stably form the dispersion comprised of the modified polyester such as urea-modified polyester or prepolymer (A) in an aqueous medium includes a method to add the components of the toner materials comprised of the modified polyester or prepolymer (A) to the aqueous medium to disperse them by a shear force. Prepolymer (A) and other toner components (hereinafter referred to as toner materials) such as colorants, colorant masterbatches, release agents, charge control agents, and unmodified polyester resins may be mixed together when a dispersion is formed in an aqueous medium, or more preferably, the toner materials are previously mixed, and the mixture is added to the aqueous medium for dispersing therein. In the present invention, other toner materials such as a colorant, a releasing agent, and a charge control agent are not necessarily required to be mixed when forming the particles in the aqueous medium, and may be added after forming the particles. For example, the colorants may be added by a known coloring method after forming the particles containing no colorant.

The dispersion method is not particularly limited, and known equipment such as those using a low-speed shearing method, a high-speed shearing method, friction, high-pressure jet, or ultrasound can be used. Of these, the high-speed shearing equipment may be adopted to make the particle diameter of the dispersion 2 to 20 μm. When the high-speed shearing disperser is used, the number of revolution is not particularly limited, usually 1,000 to 30,000 r.p.m., and preferably 5,000 to 20,000 r.p.m. The dispersion time is not particularly limited, and usually 0.1 to 5 minutes under the batch system. The dispersion temperature is usually 0 to 150° C. (under pressure), and preferably 40 to 98° C. Higher temperatures may be adopted from the viewpoint of decreasing the viscosity of the dispersion comprised of the modified polyester and prepolymer (A) for easy dispersion.

To 100 parts by weight of the toner composition including the modified polyester such as urea-modified polyester and prepolymer (A), the aqueous medium usually used is 50 to 2,000 parts by weight, and preferably 100 to 1,000 parts by weight. Below 50 parts by weight, the dispersion condition of the toner composition deteriorates, and the toner particles of a designated particle diameter are not obtained. Above 20,000 parts by weight, it is not economical. A dispersing agent may be used as needed. The use of the dispersing agent may be adopted from the viewpoint of sharpening the particle distribution and stabilizing the dispersion.

The process to synthesize the modified polyester such as urea-modified polyester from polyester prepolymer (A) may be carried out by adding an amine (B) for causing a reaction before dispersing the toner components in the aqueous medium, or by adding an amine (B) after dispersing them in the aqueous medium for causing the reaction from the particle interface. In such a case, the modified polyester is preferentially formed on the produced toner surface, thus a concentration gradient can be provided in the particles.

The dispersing agent for emulsifying and dispersing the oil phase having the dispersed toner composition into a liquid containing water includes anionic surfactants such as alkylbenzene sulfonate, α-olefin sulfonate, and phosphate; amine salt form of cationic surfactants such as alkylamine salts, amino alcohol fatty acid derivatives, polyamine fatty acid derivatives, and imidazoline, quaternary ammonium salt form of cationic surfactants such as alkyltrimethyl ammonium salts, dialkyldimethyl ammonium salts, alkyldimethylbenzyl ammonium salts, pyridinium salts, alkylisoquinolium salts, and benzethonium chloride, and nonionic surfactants such as fatty acid amide derivatives and polyalcohol derivatives; amphoteric surfactants such as alanine, dodecyldi (aminoethyl) glycine, di (octylaminoethyl) glycine, and N-alkyl-N,N-dimethyl ammonium betaine.

Surfactants having a fluoroalkyl group are effective even in a remarkably small amount. Anionic surfactants having a fluoroalkyl group which are preferably used include fluoroalkyl carboxylic acid and metal salts thereof, disodium perfluorooctanesulfonyl glutamate, sodium 3-[omega-fluoroalkyl (C6-C11)oxy]-1-alkyl (C3-C4)sulfonate, sodium 3-[omega-fluoroalkanoyl (C6-C8)-N-ethylamino]-1-propanesulfonate, fluoroalkyl (C11-C20) carboxylic acid and metal salt thereof, perfluoroalkyl carboxylic acid (C7-C13), and metal salts thereof, perfluoroalkyl (C4-C12) sulfonic acid and metal salts thereof, perfluorooctanesulfonic acid diethanolamide, N-propyl-N-(2 hydroxylethyl)perfluorooctanesulfonamide, perfluoroalkyl (C6-C10)sulfonamidepropyltrimethyl ammonium salts, perfluoroalkyl (C6-C10)-N-ethylsulfonyl glycine salts, and monoperfluoroalkyl (C6-C16)ethyl phosphate.

The product name includes SURFLON S-111, S-112 and S-113 (manufactured by Asahi Glass Co., Ltd.), FLUORAD FC-93, FC-95, FC-98 and FC-129 (manufactured by Sumitomo 3M Ltd.), UNIDYNE DS-101, DS-102 (manufactured by Daikin Industries, Ltd.), MEGAFACE F-110, F-120, F-113, F-191, F-812 and F-833 (manufactured by Dainippon Ink & Chemicals, Inc.), EFTOP EF-102, 103, 104, 105, 112, 123A, 123B, 306A, 501, 201 and 204 (manufactured by Tochem Products Co., Ltd.), and FTERGENT F-100 and F150 (manufactured by NEOS company, Ltd.).

The cationic surfactant includes aliphatic primary, secondary, or secondary amino acid having a fluoroalkyl group, aliphatic quaternary ammonium salts such as perfluoroalkyl (C6-C10) sulfonamidepropyltrimethyl ammonium salts, benzalkonium salts, benzethonium chloride, pyridinium salts, and imidazolium salts, and the product name includes Surflon S-121 (manufactured by Asahi Glass Co., Ltd.), FLUORAD FC-13 (manufactured by Sumitomo 3M Ltd.), UNIDYNE DS-202 (manufactured by Daikin Industries, Ltd.), MEGAFACE F-150, F-824 (manufactured by Dainippon Ink & Chemicals, Inc.), EFTOP EF-132 (manufactured by Tochem Products Co., Ltd.), and FTERGENT F-300 (manufactured by NEOS company, Ltd.). The cationic surfactant includes aliphatic primary, secondary, or secondary amino acid having a fluoroalkyl group, aliphatic quatemary ammonium salts such as perfluoroalkyl(C6-C 10) sulfonamidepropyltrimethyl ammonium salts, benzalkonium salts, benzethonium chloride, pyridinium salts, and imidazolium salts, and the product name includes SURFLON 121 (manufactured by Asahi Glass Co., Ltd.), FLUORAD FC-13 (manufactured by Sumitomo 3M Ltd.), UNIDYNE DS-202 (manufactured by Daikin Industries, Ltd.), MEGAFACE F-150, 824 (manufactured by Dainippon Ink & Chemicals, Inc.), EFTOP EF-132 (manufactured by Tochem Products Co., Ltd.), and FTERGENT F-300 (manufactured by NEOS company, Ltd.).

As an inorganic compound dispersing agent that is scarcely soluble in water, tripotassium phosphate, calcium carbonate, titanium oxide, colloidal silica, and hydroxyapatite may be used.

Polymeric protective colloids may be used to stabilize the dispersed droplets. Examples thereof include acids such as acrylic acid, methacrylic acid, α-cyanoacrylic acid, α-cyanomethacrylic acid, itaconic acid, crotonic acid, fumaric acid, and maleic acid or maleic anhydride; (meta)acrylic monomers having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxylpropyl acrylate, 3-chloro-2-hydroxylpropyl methacrylate, diethyleneglycol monoacrylate, diethyleneglycol monomethacrylate, glycerol monoacrylate, glycerol monomethacrylate, N-methyrol acrylamide, and N-methyrol methacrylamide; vinyl alcohol or vinyl alcohol ethers such as vinyl methyl ether, vinyl ethyl ether, and vinyl propyl ether; esters made from vinyl alcohol and a compound having a carboxyl group, such as vinyl acetate, vinyl propionic acid, and vinyl butyrate, acrylamide, methacrylamide, diacetone acrylamide, and methyrol compounds thereof; acid chlorides such as acrylic acid chloride and methacrylic acid chloride; homopolymers or copolymers of those having a nitrogen atom or a heterocycle thereof, such as vinyl viridin, vinyl pyrrolidone, vinyl imidazole, and ethyleneimine; polyoxy ethylenes such as polyoxyethylene, polyoxypropyrene, polyoxyethylene alkylamide, polyoxypropyrene alkylamide, polyoxyethylene alkylamine, polyoxypropylene alkylamine, polyoxyethylene nonylphenyl ether, polyoxyehylene laurylphenyl ether, polyoxyethylene stearylphenyl ester, and polyoxyethylene nonylphenylester; and celluloses such as methyl cellulose, hydroxyethyl cellulose, and hydroxypropyl cellulose.

When an acid such as calcium phosphate or an alkali-soluble compound is used as a dispersion stabilizer, calcium phosphate salt is dissolved with an acid such as hydrochloric acid, then the calcium phosphate salt is removed from the particles by washing or other methods. Alternatively, it can be removed by enzymatic decomposition or other operations.

When a dispersing agent is used, the dispersing agent may be left on the surface of the toner particles, but it may be preferred to wash off it after the elongation and/or crosslinking reactions from the viewpoint of charging the toner.

To decrease the viscosity of the liquid containing the toner composition, a solvent that dissolves the modified polyester such as urea-modified polyester and prepolymer (A) may be adopted. The use of the solvent may be preferred from the viewpoint of sharpening the particle distribution. The solvent may preferably be a volatile solvent having a boiling point of lower than 100° C. from the viewpoint of easiness of removal. The solvent includes toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, and methylisobutyl ketone, and they may be used alone or in a combination of two or more of them. Of these, preferably adopted are aromatic solvents such as toluene and xylene and halogenated hydrocarbons such as methylene chloride, 1,2-dichloroethane, chloroform, and carbon tetrachloride. To 100 parts of prepolymer (A), these solvents are used usually 0 to 300 parts, preferably 0 to 100 parts, and more preferably 25 to 70 parts. When the solvents are used, they are warmed and removed under a normal or reduced pressure after the elongation and/or crosslinking reactions.

The time of the elongation and/or crosslinking reactions is selected according to the reactivity of the combination of the prepolymer having active hydrogen, such as polyester prepolymer (A) and amine (B) as the crosslinking agent or elongation agent, and is usually 10 minutes to 40 hours, and preferably 2 to 24 hours. The reaction temperature is usually 0 to 150° C., and preferably 40 to 98° C. A known catalyst may be used as needed. Specific examples include dibutyl tin laurate and dioctyl tin laurate.

To remove the organic solvents from the resultant emulsified dispersion (dispersion), the following method may be used: the whole system is gradually warmed, and the organic solvents in the droplets are completely evaporated and removed. Alternatively, the emulsified dispersion is sprayed into a dry atmosphere, and the water-insoluble organic solvents in the droplets are completely removed to form the toner particles, and the aqueous dispersing agent is evaporated and removed. As the dry atmosphere into which the emulsified dispersion is sprayed, commonly used are heated gases such as air, nitrogen, carbon dioxide, and combustion gas, and particularly various airflows heated to a temperature higher than the boiling point of the solvent having the highest boiling point among the solvents to be used. Short-time processing with a spray drier, a belt drier, a rotary or the like is enough to attain target quality.

When the particle distribution in the emulsion dispersion is broad, and washing and drying processes are carried out with maintaining the particle distribution, the particles can be classified according to the desired particle diameter to adjust the particle distribution.

In the classification operation, fine particles can be removed in the liquid with a cyclone, decanter, and centrifuge. Of course the classification operation may be carried out on dried powder, but it may be adopted to carry out the operation in a liquid from the viewpoint of efficiency. The resultant unnecessary fine particles or crude particles may be returned to the kneading process for forming the particles. At that time, the fine particles or crude particles may be in wet condition.

It may be adopted to remove the used dispersing agent from the resultant dispersion as much as possible, and the removal may preferably be carried out simultaneously with the aforementioned classification operation.

The obtained dried toner powder is mixed with different types of fine particles such as release agent fine particles, charge controlling fine particles, fluidizing agent fine particles, and colorant fine particles, or a mechanical impact is applied to the mixed powder for fixing it on the surface and fuse thereon to prevent the separation of the different types of particles from the surface of the resultant composite particles.

Specific means thereof include a method to apply an impact strength to the mixture with a blade rotating at a high speed, and a method in which the mixture is put in high-velocity airflow, and the particles or combined particles accelerated therein are smashed against a suitable collision plate. Such apparatuses include an Angmill (manufactured by Hosokawa Micron Corporation), an I-type mill (manufactured by Nippon Pneumatic MFG, Co., Ltd.) modified to decrease its crushing air pressure, a Hybridization system (manufactured by Nara Machinery Co., Ltd.), Kryptron system (manufactured by Kawasaki Heavy Industries, Ltd.), and an automatic mortar.

(Carrier for Two-Component Development)

When the toner of the present invention is used in a two-component developer, it can be used in combination with a magnetic carrier, and the content ratio between the carrier and toner in the developer may preferably be that 1 to 10 parts by weight of the toner to 100 parts by weight of the carrier. As the magnetic carrier, conventionally known ones having a particle diameter of about 20 to 200 μm such as iron powder, ferrite powder, magnetite powder, and magnetic resin carrier can be used.

The covering material includes amino resins such as urea-formaldehyde resin, melamine resin, benzoguanamine resin, urea resin, and polyamide resin; and epoxy resin. Another examples include polyvinyl and polyvinylidene resins such as acrylic resin, polymethyl methacrylate resin, polyacrylonitrile resin, polyvinyl acetate resin, polyvinyl alcohol resin, and polyvinyl butyral resin; polystyrene resin and polystyrene-base resins such as styrene-acryl copolymer resin; halogenated olefin resins such as polyvinyl chloride; polyester resins such as polyethylene terephthalate resin and polybutylene terephthalate resin; polycarbonate resins, polyethylene resin; polyvinyl fluoride resin; polyvinylidene fluoride resin; polytrifluoroethylene resin; polyhexafluoropropylene resin; copolymer of vinylidene fluoride and acryl monomer; copolymer of vinylidene fluoride and vinyl fluoride; fluoroterpolymers such as terpolymer of tetrafluoroethylene, vinylidene fluoride, and non-fluorinated monomer; silicon resin; and modified silicon resins.

As needed, a conductive powder or the like may be contained in the covering resin. The conductive powder includes metal powder, carbon black, titanium oxide, tin oxide, and zinc oxide. These conductive powders preferably have an average particle diameter of 1 μm or less. When the average particle diameter exceeds 1 μm, the particles are hard to control the electric resistance.

The toner of the present invention may be used as a one-component magnetic toner or a non-magnetic toner using no carrier.

Figure 3:
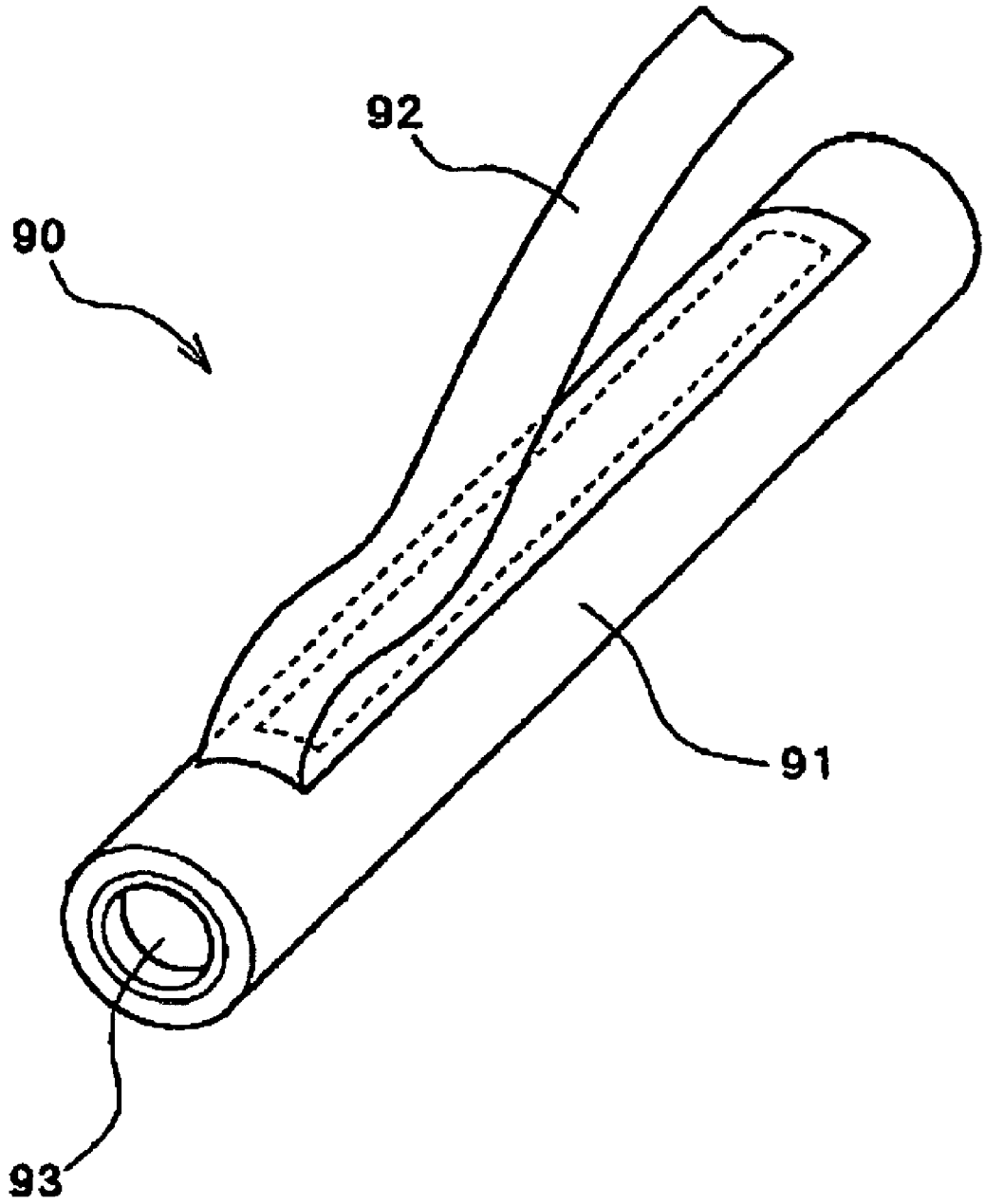
FIG. 3 is a drawing representing an example of a toner container of the present invention.

FIG. 3 shows an example of the toner container of the present invention.

In FIG. 3, numeral 90, 91, 92 and 93 represent a toner container, a case, a seal and a stopper, respectively. In a one-component developer, the toner for developing an electrostatic image of the present invention is contained in the toner container, and in the two-component developer, the toner for developing an electrostatic image of the present invention and carrier are contained in the toner container.

The process cartridge in the present invention is comprised of at least a combination of a toner receiver, a developing means and a photoconductor, and the process cartridge removably equipped with the main unit of an image forming apparatus such as a copier and a printer. In addition, a charging means, a cleaning means and a photoconductor may be in combination.

The process cartridge containing the toner of the present invention can be of compact design that improves the usability by users. Since the toner of the present invention has a uniform shape, a large quantity of the toner can be contained in the toner receiver. In addition, the toner surface in scab form allows attaining suitable frictional charging property even when the developing means is compact and simple.

EXAMPLES

The present invention is described in detail below with reference to the following preferred examples, but the present invention should not be construed as being limited thereto. Hereinafter all parts are given by weight.

Example 1

451 g of 0.1 M-$Na_3PO_4$ aqueous solution was added to 709 g of ion exchange water, and the mixture was heated to 60° C. and stirred with a TK homomixer at 12,000 r.p.m. To the mixture, 68 g of 1.0 M-$CaCl_2$ aqueous solution was gradually added, and an aqueous medium containing $Ca_3(PO4)_2$ was obtained. 170 g of styrene, 30 g of 2-ethylhexyl acrylate, 10 g of REGAl 400R, 60 g of paraffin wax (s.p. 70° C.), 5 g of di-tert-butyl salicylate metal compound, 10 g of styrene-methacrylic acid copolymer (Mw 50,000, acid value 20 mg KOH/g) were charged into a TK homomixer, heated to 60° C., and homogeneously dissolved and dispersed at 12,000 r.p.m. 10 g of 2,2'-azobis(2,4-dimethylvaleronitrile) as a polymerization initiator was dissolved in the dispersion to prepare a polymer-monomer system.

The polymer-monomer system was put in the aqueous medium, and stirred with a TK homomixer at 10,000 r.p.m. for 20 minutes at 60° C. in a $N_2$ atmosphere to pulverize the polymer-monomer system. After that, it was allowed to react at 60° C. for three hours with stirring with a paddle stirring blade, and then the liquid was heated to 80° C. and allowed to react for 10 hours.

After the polymerization reaction completed, the liquid was cooled and hydrochloric acid was added to it to dissolve calcium phosphate. The liquid was filtered, washed, and the dispersion of colored particles 1 was obtained. To 100 parts of the solid of the dispersion, 4 parts (in terms of solid) of AQUALIC GL (manufactured by Nippon Shokubai Co., Ltd.) was added as a surface treating agent, and stirred for one hour at room temperature, and dried with a spray drier GS31 (Yamato Science Co., Ltd.) to obtain a [toner 1] having a volume average particle diameter Dv of 6.30 μm, a number average particle diameter Dn of 5.65 μm, a ratio of Dv to Dn of 1.12, and a circularity of 0.983. According to an observation with a SEM, the surface of toner 1 was wholly in scab form.

Example 2

To 100 parts of the solid of the dispersion of colored particles 1 as described in Example 1, one part (in terms of solid) of AQUALIC GL (manufactured by Nippon Shokubai Co., Ltd.) was added as a surface treating agent, stirred at room temperature for one hour, and dried with a spray drier GS31 (manufactured by Yamato Science Co., Ltd.) to obtain [toner 2]. According to an observation with a SEM, the surface of toner 2 was not wholly but partially in scab form.

Comparative Example 1

The dispersion of colored particles 1 as described in Example 1 was dried in a spray drier GS31 (manufactured by Yamato Science Co., Ltd.) to obtain [toner 3]. According to an observation with a SEM, the surface of toner 3 was not in scab form.

To 100 parts of the toners obtained in Examples 1 and 2, and Comparative example 1, 0.7 parts of hydrophobic silica and 0.3 parts of hydrophobic titanium oxide were added, and mixed with a HENSCHEL mixer. Developers composed of 5 % by weight of the toner treated with external additives and 95 % by weight of a copper-zinc ferrite carrier that had an average particle diameter of 40 μm and was covered with a silicon resin containing an aminosilane coupling agent were prepared, and continuous printing was carried out with them using a printer imagio MF4570 (manufactured by Ricoh Co., Ltd.), which can print 45 sheets of A4 paper in a minute. The results are shown in Table 1.

TABLE 1

| | | Frictional charge quantity (μC/g) | | | Scumming | | | Fixing properties (° C.) | |
|---|---|---|---|---|---|---|---|---|---|
| | | Start | After printing 10,000 sheets | After printing 100,000 sheets | Start | After printing 10,000 sheets | After printing 100,000 sheets | Lower limit of fixing temperature | Offset occurrence temperature |
| Example 1 | Toner 1 | 35.9 | 39.8 | 37.2 | 0.00 | 0.00 | 0.00 | 160 | 230 |
| Example 2 | Toner 2 | 33.3 | 36.1 | 34.0 | 0.01 | 0.03 | 0.03 | 150 | 225 |
| Comparative Example 3 | Toner 3 | 32.5 | 35.4 | 31.7 | 0.02 | 0.34 | 0.57 | 140 | 220 |

Example 3

(1) (Synthesis of Organic Fine Particle Emulsion)

683 parts of water, 11 parts of a sodium salt of a sulfate ester of an adduct of ethylene oxide methacrylate (ELEMINOL RS-30: manufactured by Sanyo Chemical Industries, Ltd.), 138 parts of styrene, 138 parts of methacrylic acid, and 1 part of ammonium persulfate were stirred for 15 minutes at 400 r.p.m. in a reaction vessel equipped with a stirring rod and a thermometer to obtain a white emulsion. The emulsion was heated until the temperature in the system reached 75° C., and allowed to react for five hours. The reactant was further added with 30 parts of 1% ammonium persulfate aqueous solution, and aged at 75° C. for five hours to obtain an aqueous dispersion of a vinyl resin (copolymer of styrene-methacrylic acid-sodium salt of sulfate ester of an adduct of ethylene oxide methacrylate) [fine particle dispersion 1]. The volume average particle diameter of [fine particle dispersion 1]measured by a LA-920 was 0.14 μm. A part of [fine particle dispersion 1]was dried to isolate the resin component. The Tg of the resin component was 152° C.

(2) (Preparation of Aqueous Phase)

990 parts of water, 80 parts of [fine particle dispersion 1], 40 parts of a 48.5% aqueous solution of sodium dodecyldiphenyletherdisulfonate (Eleminol MON-7: manufactured by Sanyo Chemical Industries, Ltd.), and 990 parts of water, 80 parts of [fine particle dispersion 1], 40 parts of a 48.5% aqueous solution of sodium dodecyldiphenyletherdisulfonate ELEMIINOL MON-7: manufactured by Sanyo Chemical Industries, Ltd.), and 90 parts of ethyl acetate were mixed and stirred to obtain an opal liquid [aqueous phase 1].

(3) (Synthesis of Low Molecular Weight Polyester 1)

220 parts of an adduct of bisphenol A with 2 moles of ethylene oxide, 561 parts of an adduct of bisphenol A with 3 moles of propylene oxide, 218 parts of terephthalic acid, 48 parts of adipic acid and 2 parts of dibutyl tin oxide were put in a reaction vessel equipped with a cooling pipe, stirrer, and nitrogen gas-introducing tube, and allowed to react at 230° C. for 8 hours under a normal pressure, followed by further reaction for 5 hours under a reduced pressure of 10 to 15 mmHg. After that, 45 parts of trimellitic acid anhydride were added to the reaction vessel, and allowed to react at 180° C. for two hours under a normal pressure to obtain [low molecular polyester 1]. [Low molecular polyester 1] had a number average molecular weight of 2500, a weight average molecular weight of 6,700, a Tg of 43° C., and an acid value of 25.

(4) (Synthesis of Prepolymer 1)

682 parts of an adduct of bisphenol A with 2 moles of ethylene oxide, 81 parts of an adduct of bisphenol A with 2 moles of propylene oxide, 283 parts of terephthalic acid, 22 parts of trimellitic acid anhydride and 2 parts of dibutyl tin oxide were put in a reaction vessel equipped with a cooling pipe, stirrer, and nitrogen gas-introducing tube, and allowed to react at 230° C. for 8 hours under a normal pressure, followed by further reaction for 5 hours under a reduced pressure of 10 to 15 mmHg to obtain [intermediate polyester 1]. [Intermediate polyester 1] had a number average molecular weight of 2,100, a weight average molecular weight of 9,500, a Tg of 55° C., an acid value of 0.5 and a hydroxyl value of 49.

After that, 411 parts of [intermediate polyester 1], 89 parts of isophorone diisocyanate and 500 parts of ethyl acetate were put in a reaction vessel equipped with a cooling pipe, stirrer, and nitrogen gas-introducing tube, and allowed to react at 100° C. for 5 hours to obtain [Prepolymer 1]. [Prepolymer 1] contained 1.53% by weight of free isocyanate.

(5) (Synthesis of Ketimine)

170 parts of isophoronediamine and 75 parts of methylethyl ketone was put in a reaction vessel equipped with a stirring rod and a thermometer, and allowed to react at 50° C. for 5 hours to obtain [ketimine compound 1]. [Ketimine compound 1] had an amine value of 418.

(6) (Synthesis of Masterbatch)

Pigment carbon black (REGAL 400 R manufactured by Cabot Corp.) 40 parts Binder resin: polyester resin (RS-801 manufactured by Sanyo Chemical Industries, Ltd., acid value 10, Mw 20,000, Tg 64° C.) 60 parts Water 30 parts.

Binder resin: polyester resin (RS-801 manufactured by Sanyo Chemical Industries, Ltd., acid value 10, Mw 20,000, Tg 64° C.) 60 parts Water 30 parts.

The above raw materials were mixed with a HENSCHEL mixer to obtain a mixture containing a pigment aggregate dampened with water. The mixture was kneaded for 45 minutes with two rolls adjusted to a roll surface temperature of 130° C., and pulverized with a pulverizer into particles of a diameter of 1 mm to obtain [masterbatch 1]. Then, the masterbatch pigment was made into a toner by the following method.

(7) (Preparation of Oil Phase)

378 parts of [low molecular weight polyester 1], 110 parts of carnauba wax and 947 parts of ethyl acetate were put in a vessel equipped with a stirring rod and a thermometer, heated to 80° C. and kept at 80° C. for five hours with stirring, followed by cooling to 30° C. in one hour. Then, 500 parts of [masterbatch 1] and 500 parts of ethyl acetate were put in the vessel, followed by mixing for one hour to obtain [raw material solution 1].

1324 parts of [raw material solution 1] was transferred to a vessel, and the carbon black and wax were dispersed in three passes using a bead mill (ULTRA VISCO MILL manufactured by AIMEX Co., Ltd.) under conditions of a liquid transfer rate of 1 kg/hr, a disk peripheral velocity of 6 m/second and a loading of 0.5 mm zirconia beads of 80% by volume. Then, 1324 parts of a 65% solution of [low molecular polyester 1] in ethyl acetate was added, dispersed in one pass using the bead mill under the aforementioned conditions to obtain [pigment-wax dispersion 1]. The solid content of [pigment-wax dispersion 1] was 50% (130° C., 30 minutes).

(8) (Emulsification→Desolvation)

648 parts of [pigment-wax dispersion 1], 154 parts of [Prepolymer 1] and 6.6 parts of [ketimine compound 1] were put in a vessel, and mixed at 5,000 r.p.m. for one minute using a TK homomixer (manufactured by Tokushu Kika Kogyo Co., Ltd.). To the vessel, 1,200 parts of [aqueous phase 1] were added, and mixed at 13,000 r.p.m. for 20 minutes to obtain [emulsified slurry 1].

[Emulsified slurry 1] was put in a vessel equipped with a stirrer and a thermometer, desolvated at 30° C. for eight hours, followed by aging at 45° C. for four hours to obtain [dispersed slurry 1]. [Dispersed slurry 1] had a volume average particle diameter of 6.18 μm and a number average particle diameter of 5.45 μm (measured by Multisizer II).

(9) (Washing→Drying)

After filtering 100 parts of [emulsified slurry 1] under a reduced pressure,

1:100 parts of ion exchange water were added to a filter cake, mixed using a TK homomixer at 12,000 r.p.m. for 10 minutes, followed by filtration.

2:100 parts of 10% sodium hydroxide aqueous solution were added to the cake as described in 1, ultrasonic vibrations were applied, and mixed using a TK homomixer at 12,000 r.p.m. for 30 minutes, followed by filtration under a reduced pressure.

3:100 parts of 10% hydrochloric acid were added to the filter cake as described in 2, and mixed using a TK homomixer at 12,000 r.p.m. for 10 minutes, followed by filtration.

4:300 parts of ion exchange water were added to the filter cake as described in 3, and the operations of mixing using a TK homomixer at 12,000 r.p.m. for 10 minutes and filtration were repeated twice to obtain [filter cake 1].

[Filter cake 1] was dried at 45° C. for 48 hours using a circulating wind drier, sieved through a 75-μm mesh screen to obtain [toner base particles 1] having a volume average particle diameter Dv of 6.09 μm, a number average particle diameter Dn of 5.52 μm, a ratio of Dv to Dn of 1.10 (measured by a Multisizer II) and a resin fine particle abundance ratio of 0.5% by weight.

(10) (External Addition of Charge Control Agent)

To 100 parts of [toner base particles 1], 0.5 parts of CCA (salicylic acid metal complex E-84: manufactured by Orient Chemical Industries, Ltd.) was added, and mixed using a Q-type mixer (manufactured by Mitsui Mining Co., Ltd.) for ten minutes in total, including 5 cycles of two-minute operation and one-minute pause at a peripheral speed of the turbine blade of 85 m/sec, to obtain [toner 4] having a volume average particle diameter Dv of 6.20 μm, a number average particle diameter Dn of 5.70 μm, a ratio of Dv to Dn of 1.09 and a resin fine particle abundance ratio of 0.5% by weight.

Example 4

(1) (Synthesis of Low Molecular Weight Polyester 2)

262 parts of an adduct of bisphenol A with 2 moles of ethylene oxide, 202 parts of an adduct of bisphenol A with 2 moles of propylene oxide, 236 parts of an adduct of bisphenol A with 3 moles of propylene oxide, 266 parts of terephthalic acid, 48 parts of adipic acid and 2 parts of dibutyl tin oxide were put in a reaction vessel equipped with a cooling pipe, stirrer, and nitrogen gas-introducing tube, and allowed to react at 230° C. for 8 hours under a normal pressure, followed by further reaction for 5 hours under a reduced pressure of 10 to 15 mmHg. After that, 34 parts of trimellitic acid anhydride were added to the reaction vessel, and allowed to react at 180° C. for two hours under a normal pressure to obtain [low molecular polyester 2]. [Low molecular polyester 2] had a number average molecular weight of 2,390, a weight average molecular weight of 6,010, a Tg of 62° C., and an acid value of 20.7.

(2) (Preparation of Oil Phase)

378 parts of [low molecular weight polyester 2], 110 parts of carnauba wax and 947 parts of ethyl acetate were put in a vessel equipped with a stirring rod and a thermometer, heated to 80° C. and kept at 80° C. for five hours with stirring, followed by cooling to 30° C. in one hour. Then, 500 parts of [masterbatch 1] and 500 parts of ethyl acetate were put in the vessel, followed by mixing for one hour to obtain [raw material solution 2].

1324 parts of [raw material solution 2] were transferred to a vessel, and the carbon black and wax were dispersed in three passes using a bead mill (ULTRA VISCO MILL manufactured by AIMEX Co., Ltd.) under conditions of a liquid transfer rate of 1 kg/hr, a disk peripheral velocity of 6 m/second, a loading of 0.5 mm zirconia beads of 80% by volume. Then, 1324 parts of a 65% solution of [low molecular polyester 2] in ethyl acetate were added, dispersed using the bead mill in one pass under the aforementioned conditions to obtain [pigment-wax dispersion 2]. The solid content of [pigment-wax dispersion 2] was 52% (130° C., 30 minutes).

(3) The procedure as described in Example 3 was carried out except that [pigment-wax dispersion 1] as described in Example 3 was replaced with [pigment-wax dispersion 2], and alkali washing was carried out twice without applying an ultrasonic wave to obtain [toner 5] having a volume average particle diameter Dv of 6.24 μm, a number average particle diameter Dn of 5.48 μm, a ratio of Dv to Dn of 1.14 and a resin fine particle abundance ratio of 1.2% by weight.

Example 5

(1) (Synthesis of Low Molecular Polyester 3)

719 parts of an adduct of bisphenol A with 2 moles of propylene oxide, 274 parts of terephthalic acid, 48 parts of adipic acid and 2 parts of dibutyl tin oxide were put in a reaction vessel equipped with a cooling pipe, a stirrer, and a nitrogen gas-introducing tube, and allowed to react at 230° C. for 8 hours under a normal pressure, followed by further reaction for 5 hours under a reduced pressure of 10 to 15 mmHg. After that, 7 parts of trimellitic acid anhydride were added to the reaction vessel, and allowed to react at 180° C. for two hours under a normal pressure to obtain [low molecular polyester 3]. [Low molecular polyester 3] had a number average molecular weight of 2,290, a weight average molecular weight of 5,750, a Tg of 65° C., and an acid value of 4.9.

(2) (Preparation of Oil Phase)

378 parts of [low molecular weight polyester 3], 110 parts of carnauba wax and 947 parts of ethyl acetate were put in a vessel equipped with a stirring rod and a thermometer, heated to 80° C. and kept at 80° C. for five hours with stirring, followed by cooling to 30° C. in one hour. Then, 500 parts of [masterbatch 1] and 500 parts of ethyl acetate were put in the vessel, followed by mixing for one hour to obtain [raw material solution 3].

1324 parts of [raw material solution 3] were transferred to a vessel, and the carbon black and wax were dispersed in three passes using a bead mill (ULTRA VISCO MILL manufactured by AIMEX Co., Ltd.) under conditions of a liquid transfer rate of 1 kg/hr, a disk peripheral velocity of 6 m/second, a loading of 0.5 mm zirconia beads of 80% by volume. Then, 1,324 parts of a 65% solution of [low molecular polyester 3] in ethyl acetate were added, dispersed using the bead mill in one pass under the aforementioned conditions to obtain [pigment-wax dispersion 3]. The solid content of [pigment-wax dispersion 3] was 49% (130° C., 30 minutes).

(3) The procedure as described in Example 3 was carried out except that [pigment-wax dispersion 1] as described in Example 3 was replaced with [pigment-wax dispersion 3], and alkali washing was carried out four times without applying an ultrasonic wave to obtain [toner 6] having a volume average particle diameter Dv of 7.05 μm, a number average particle diameter Dn of 5.82 μm, a ratio of Dv to Dn of 1.21 and a resin fine particle abundance ratio of 1.5% by weight.

Example 6

(1) (Synthesis of Low Molecular Polyester 4)

121 parts of an adduct of bisphenol A with 2 moles of ethylene oxide, 64 parts of an adduct of bisphenol A with 2 moles of propylene oxide, 527 moles of an adduct of bisphenol A with 3 moles of propylene oxide, 246 parts of terephthalic acid, 48 parts of adipic acid and 2 parts of dibutyl tin oxide were put in a reaction vessel equipped with a cooling pipe, a stirrer, and a nitrogen gas-introducing tube, and allowed to react at 230° C. for 8 hours under a normal pressure, followed by further reaction under a reduced pressure of 10 to 15 mmHg for five hours. After that, 42 parts of trimellitic acid anhydride were added to the reaction vessel, and allowed to react at 180° C. for two hours under a normal pressure to obtain [low molecular polyester 4]. [Low molecular polyester 4] had a number average molecular weight of 2,500, a weight average molecular weight of 6,190, a Tg of 48° C., and an acid value of 25.2.

(2) (Preparation of Oil Phase)

378 parts of [low molecular weight polyester 4], 110 parts of carnauba wax and 947 parts of ethyl acetate were put in a vessel equipped with a stirring rod and a thermometer, heated to 80° C. and kept at 80° C. for five hours with stirring, followed by cooling to 30° C. in one hour. Then, 500 parts of [masterbatch 1] and 500 parts of ethyl acetate were put in the vessel, followed by mixing for one hour to obtain [raw material solution 4].

1324 parts of [raw material solution 4] were transferred to a vessel, and the carbon black and wax were dispersed in three passes using a bead mill (ULTRA VISCO MILL manufactured by AIMEX Co., Ltd.) under conditions of a liquid transfer rate of 1 kg/hr, a disk peripheral velocity of 6 m/second, a loading of 0.5 mm zirconia beads of 80% by volume. Then, 1324 parts of a 65% solution of [low molecular polyester 4] in ethyl acetate were added, dispersed using the bead mill in one pass under the aforementioned conditions to obtain [pigment-wax dispersion 4]. The solid content of [pigment-wax dispersion 4] was 49% (130° C., 30 minutes).

(3) The procedure as described in Example 3 was carried out except that [Pigment-wax dispersion 1] as described in Example 3 was replaced with [pigment-wax dispersion 4] to obtain [toner 7] having a volume average particle diameter Dv of 5.24 μm, a number average particle diameter Dn of 4.30 μm, a ratio of Dv to Dn of 1.22 and a resin fine particle abundance ratio of 1.0% by weight.

Example 7

The procedure as described in Example 3 was carried out except that ultrasonic alkali washing as described in Example 3 was carried out twice to obtain [toner 8] having a volume average particle diameter Dv of 5.80 μm, a number average particle diameter Dn of 5.17 μm, a ratio of Dv to Dn of 1.12 and a resin fine particle abundance ratio of 0.2% by weight.

Example 8

The procedure as described in Example 4 was carried out except that ultrasonic alkali washing as described in Example 4 was carried out once without applying an ultrasonic wave to obtain [toner 9] having a volume average particle diameter Dv of 6.32 μm, a number average particle diameter Dn of 5.29 μm, a ratio of Dv to Dn of 1.19 and a resin fine particle abundance ratio of 2.5% by weight.

Example 9

The procedure as described in Example 3 was carried out except that [pigment-wax dispersion 1] as described in Example 3 was replaced with [pigment-wax dispersion 3], and that alkali washing was carried out twice without applying an ultrasonic wave to obtain [toner 10] having a volume average particle diameter Dv of 7.05 μm, a number average particle diameter Dn of 5.72 μm, a ratio of Dv to Dn of 1.23 and a resin fine particle abundance ratio of 2.0% by weight.

Example 10

The procedure as described in Example 3 was carried out except that [pigment-wax dispersion 1] as described in Example 3 was replaced with [pigment-wax dispersion 4], and that ultrasonic alkali washing was carried out twice to obtain [toner 11] having a volume average particle diameter Dv of 4.80 μm, a number average particle diameter Dn of 3.90 μm, a ratio of Dv to Dn of 1.23 and a resin fine particle abundance ratio of 0.3% by weight.

Example 11

The procedure as described in Example 3 was carried out except that ultrasonic alkali washing as described in Example 3 was not conducted to obtain [toner 12] having a volume average particle diameter Dv of 6.21 μm, a number average particle diameter Dn of 5.30 μm, a ratio of Dv to Dn of 1.17 and a resin fine particle abundance ratio of 3.5% by weight.

Example 12

The procedure as described in Example 3 was carried out except that the peripheral speed of the turbine blade as described in Example 3 was adjusted to 35 m/sec to obtain [toner 13] having a volume average particle diameter Dv of 6.19 μm, a number average particle diameter Dn of 5.69 μm, a ratio of Dv to Dn of 1.09 and a resin fine particle abundance ratio of 0.5% by weight.

Comparative Example 2

(1) (Preparation of Wax Particle Aqueous Dispersion) 500 ml of deaerated distilled water, 28.5 g of NEWCOL 565C (manufactured by Nippon Nyukazai Co., Ltd.) and 185.5 g of Candelilla Wax No. 1 (manufactured by Cerarica NODA Co., Ltd.) were put into a 4-neck 1,000-mi conical flask equipped with a stirring apparatus, a temperature sensor, a nitrogen gas-introducing tube and a cooling pipe, and heated with stirring in a nitrogen airflow. When the internal temperature reached 85° C., 5N-sodium hydroxide aqueous solution was added, and heated to 75° C. After that, heating and stirring were continued for one hour, followed by cooling to room temperature to obtain [wax particle aqueous dispersion 1].

(2) (Preparation of Colorant Aqueous Dispersion)

100 g of carbon black (product name:MOGUL L, manufatured by Cabot Corp.)and 25 g of sodium dodecyl sulfate were added to 540 ml of distilled water, thoroughly stirred, followed by dispersion using a pressure disperser(MINILAB:manufactured by Rani Co., Ltd.)to obtain [colorant dispersion I].

(3) (Synthesis of Binder Fine Particle Aqueous Dispersion)

480 ml of distilled water, 0.6 g of sodium dodecyl sulfate, 106.4 g of styrene, 43.2 g of n-butyl acrylate and 10.4 g of methacrylic acid were put into a 4-neck 1-l conical flask equipped with a stirring apparatus, a cooling pipe, a temperature sensor, and a nitrogen gas-introducing tube, and heated to 70° C. with stirring in a nitrogen airflow. To the mixture an initiator aqueous solution prepared by dissolving 2.1 g of potassium persulfate in 120 ml of distilled water was added, stirred at 70° C. for three hours in a nitrogen airflow to complete the polymerization, followed by cooling to room temperature to obtain [high molecular weight binder fine particle dispersion 1].

2,400 ml of distilled water, 2.8 g of sodium dodecyl sulfate, 620 g of styrene, 128 g of n-butyl acrylate, 52 g of methacrylic acid and 27.4 g of tert-dodecyl mercaptan were put into a four-neck 5-l conical flask equipped with a stirring apparatus, a cooling pipe, a temperature sensor and a nitrogen gas-introducing tube, heated to 70° C. with stirring in a nitrogen airflow. To the mixture an initiator aqueous solution prepared by dissolving 11.2 g of potassium persulfate in 600 ml of distilled water was added, stirred at 70° C. for three hours in a nitrogen airflow to complete the polymerization, followed by cooling to room temperature to obtain [low molecular weight binder fine particle dispersion 2].

(4) (Synthesis of Toner)

47.6 g of [high molecular weight binder fine particle dispersion 1], 190.5 g of [low molecular weight binder fine particle dispersion 2], 7.7 g of [wax particle aqueous dispersion 1], 26.7 g of [colorant dispersion I] and 252.5 ml of distilled water were put in a 1-1 separable flask equipped with a stirring apparatus, a cooling pipe and a temperature sensor, mixed by stirring, and the pH was adjusted to 9.5 using a 5 N-sodium hydroxide aqueous solution. With keeping stirring, a sodium chloride aqueous solution prepared by dissolving 50 g of sodium chloride in 600 ml of distilled water, and 77 ml of isopropanol, a surfactant aqueous solution prepared by dissolving 10 mg of FLUORAD EC-170 C (manufactured by Sumitomo 3M Ltd.) in 10 ml of distilled water were sequentially added, allowed to react for six hours after the internal temperature was increased to 85° C., followed by cooling to room temperature. The pH of the reaction liquid was adjusted to 13 using a 5 N-sodium hydroxide aqueous solution, followed by filtration. The filtrate was washed by repeatedly performing suspension in distilled water and filtration and dried to obtain [toner 14] having a volume average particle diameter Dv of 6.52 μm, a number average particle diameter Dn of 5.31 μm and a ratio ofDv to Dn of 1.23.

Comparative Example 3

(1) (Preparation of Pigment Dispersion)

0.9 parts by weight of sodium n-dodecyl sulfate and 10 parts by weight of ion exchange water were put in a resin container, and stirred to prepare a sodium n-dodecyl sulfate aqueous solution. With stirring the aqueous solution, 1.2 parts by weight of carbon black: REGAL 400 R (manufactured by Cabot Corp.) were gradually added. After the addition, the mixture was stirred for one hour, and carbon black was dispersed continuously for 20 hours using a sand grinder to obtain [pigment dispersion (C-1)].

(2) (Preparation of Surfactant Aqueous Solution]

0.05 5 parts by weight of sodium dodecylbenzenesulfonic acid that is an anionic surfactant and 4 parts by weight of ion exchange water were put in a stainless pot, and the system was stirred at room temperature to obtain [preparation example (S-1)]. 0.014 parts by weight of NEWCOL 565 C that is a nonionic surfactant (manufactured by Nippon Nyukazai Co., Ltd.), and 4 parts by weight of ion exchange water were put in a stainless pot, and the system was stirred at room temperature to obtain [preparation example (S-2)]. One part by weight of FC-170 C that is a nonionic surfactant (manufactured by Sumitomo 3M Ltd.), and 1,000 parts by weight of ion exchange water were put in a glass beaker, and the system was stirred at room temperature to obtain [preparation example (S-3)].

(3) (Preparation of Polymerization Initiator Aqueous Solution)

200.7 parts by weight of potassium persulfate (manufactured by Kanto Chemical Co., Inc.) that is a polymerization initiator, and 12,000 parts by weight of ion exchange water were put in an enameled pot, and the system was stirred at room temperature to obtain [preparation example (P-1)]. 223.8 parts by weight of potassium persulfate (manufactured by Kanto Chemical Co., Inc.) that is a polymerization initiator, and 12,000 parts by weight of ion exchange water were put in an enameled pot, and the system was stirred at room temperature to obtain [preparation example (P-2)].

(4) (Preparation of Sodium Chloride Aqueous Solution)

5.36 parts by weight of sodium chloride (manufactured by Wako Pure Chemical Industries, Ltd.) that is a salting agent and 20 parts by weight of ion exchange water were put in a stainless pot, and the system was stirred at room temperature to obtain [sodium chloride solution (N)].

(5) (Preparation of Toner Particles)

4 l of [preparation example (S-1) and 4 l of [preparation example (S-2)] were put into a glass-lined reaction vessel having an internal volume of 100 l and equipped with a temperature sensor, a cooling pipe, a nitrogen introducing apparatus and a stirring blade, 44 l of ion exchange water was added to the system with stirring at room temperature, and the system was heated. When the temperature of the system reached 70° C., 12 l of [preparation example (P-1)] was added, and a monomer mixture (I) composed of 12.1 kg of styrene, 2.88 kg of n-butyl acrylate, 1.04 kg of methacrylic acid and 9.02 g of t-dodecyl mercaptan was added with keeping the temperature of the system at 72° C.±1° C., and stirring was continued for six hours with keeping the temperature of the system at 80° C.±1° C. After cooling the system to 40° C. or lower, 4 l of [preparation example (S-1)] and 4 l of [preparation example (S-2)] were added to the system, and the system was heated. When the temperature of the system reached 70° C., 12 l of [preparation example (P-2)] was added, and a monomer mixture (II) composed of 11 kg of styrene, 4 kg of n-butyl acrylate, 1.04 kg of mechacrylic acid and 548 g of t-dodecyl mercaptan was further added. The system was stirred for six hours with keeping the temperature of the system at 75° C.±2° C., and further stirred for 12 hours with keeping the temperature of the system at 80° C.±2° C. The system was cooled until the temperature of the system decreased to 40° C. or lower, and stirring was stopped. Scales (foreign substances) were removed by filtering through a pole filter to obtain [composite latex (1-A)] that is a dispersion of composite resin fine particles (A) composed of a core of a high molecular weight resin and a shell of a low molecular weight resin. The peak molecular weight of the high molecular weight resin (core) of the composite resin fine particles (A) was 29,000, the peak molecular weight of the low molecular weight resin (shell) was 12,000, and the weight average molecular weight of the composite resin fine particles (A) was 34,000. The weight average particle diameter of the composite resin fine particles (A) was 150 nm, the glass transition temperature (Tg) was 58° C., and the softening point was 121° C.

4 l of [preparation example (S-1) and [preparation example (S-2)] were put into a glass-lined reaction vessel having an internal volume of 100 l and equipped with a temperature sensor, a cooling pipe, a nitrogen introducing apparatus, a comb baffle and a stirring blade (Faudler blade), and 44 l of ion exchange water was added to the system with stirring at room temperature, and the system was heated. When the temperature of the system reached 70° C., 12 l of [preparation example (P-1)] was added, and a monomer mixture composed of 11 kg of styrene, 4 kg of n-butyl acrylate, 1.04 kg of methacrylic acid and 9.02 g of t-dodecyl mercaptan was added, and stirred for six hours with keeping the temperature of the system at 72° C.±2° C., and stirring was continued for another 12 hours with keeping the temperature of the system at 80° C.±2° C. The system was cooled to 40° C. or lower, and stirring was stopped. Scales (foreign substance) were removed by filtering through a pole filter to obtain [latex (1-B)] that is a dispersion of resin fine particles (B). The peak molecular weight of the resin fine particles (B) composing latex (1-B) was 310,000, and the weight average molecular weight was 190,000. The weight average particle diameter of resin fine particles (B) was 138 nm, and the glass transition temperature (Tg) was 58° C., and the softening point was 126° C.

20 kg of [composite latex (1-A)], 0.4 kg of [pigment dispersion (C-1)] and 20 kg of ion exchange water were put in a stainless reaction vessel having an internal volume of 100 l and equipped with a temperature sensor, a cooling pipe, a nitrogen introducing apparatus, a comb baffle and a stirring blade (anchor blade), and the system was stirred at room temperature. The system was heated to 40° C., 20 l of sodium chloride aqueous solution (N), 6 kg of isopropyl alcohol (manufactured by Kanto Chemical Co., hc.), 1 part by weight of FC-170C (manufactured by Sumitomo 3M Ltd.) that is a nonionic surfactant, and 1,000 parts by weight of ion exchange water were put in a glass beaker, and the system was stirred at room temperature to obtain [preparation example (S-3)]. 11 of [preparation example (S-3)] was added in this order. After the system was allowed to stand for 10 minutes, heated to 85° C. in 60 minutes, and stirred at 85° C. ±2° C. for one hour for salting out and fusing composite resin fine particles (A) and colored fine particles to form colored particles (core particles). Then, 5.2 kg of [latex (1-B)] and 3.41 kg of wax emulsion (polypropylene emulsion of a number average molecular weight of 3,000, a number average primary particle diameter of 120 nm and a solid content of 29.9 % by weight) were added at a temperature of 85° C.±2° C., and stirred at 85° C.±2° C. for four hours for attaching resin fine particles (B) and polypropylene fine particles to the surface of the colored particles (core particles) by means of salting out/fusion. After cooling the system to 40° C. or lower, stirring was stopped, and the aggregate was removed by filtering through a 45-μm mesh screen to obtain a dispersion of the toner particles. After that, the dispersion was filtered under a reduced pressure to obtain a wet cake (an aggregate of the toner particles), and the wet cake was washed with ion exchange water. The washed wet cake was taken out from a Nutsche, and dried in 100 hours using an air drier at 40° C. to obtain an aggregate of the toner particles in block form. Then, the aggregate was pulverized using a HENSCHEL pulverizer to obtain [toner 15] having a volume average particle diameter Dv of 6.40 μm, a number average particle diameter Dn of 5.30 μm, a ratio of Dv to Dn of 1.21.

Comparative Example 4

One part of polyvinyl alcohol (PVA-235, manufactured by Kuraray Co., Ltd.) was dissolved in 100 parts of water to obtain [water phase 2]. The procedure as described in Example 3 was carried out except that [water phase 1] as described in Example 3 was replaced with [water phase 2] to obtain [toner 16].

The circularity and the number of small projections of the toners obtained in the Examples and Comparative examples were measured to calculate the ratio of the number of the small projections to the circularity. The results are shown in Table 2.

TABLE 2

| | Circularity | Number of small projections | Number of small projections/circularity |
|---|---|---|---|
| Toner 1 | 0.983 | 4 | 4.069 |
| Toner 2 | 0.983 | 1 | 1.017 |
| Toner 3 | 0.983 | 0 | 0.000 |
| Toner 4 | 0.950 | 4 | 4.211 |
| Toner 5 | 0.951 | 8 | 8.412 |
| Toner 6 | 0.953 | 10 | 10.493 |
| Toner 7 | 0.955 | 7 | 7.330 |
| Toner 8 | 0.957 | 1 | 1.045 |
| Toner 9 | 0.943 | 13 | 13.786 |
| Toner 10 | 0.958 | 12 | 12.526 |
| Toner 11 | 0.952 | 2 | 2.101 |
| Toner 12 | 0.950 | 20 | 21.053 |
| Toner 13 | 0.950 | 4 | 4.211 |
| Toner 14 | 0.960 | 0 | 0.000 |
| Toner 15 | 0.958 | 0 | 0.000 |
| Toner 16 | 0.902 | 0 | 0.000 |

To 100 parts of the toners obtained in Examples 3 to 12 and Comparative examples 2 to 4, 0.7 parts of hydrophobic silica and 0.3 parts of hydrophobic titan oxide were added, and mixed using a Henschel mixer. The physical properties of the resultant toners are shown in Table 3.

Developers composed of 5% by weight of the toners treated with the external additives and 95% by weight of a copper-zinc ferrite carrier covered with silicon resin and having a average particle diameter of 40 μm were prepared, and used for continuous printing with an imagio Neo 450 (manufactured by Ricoh Co., Ltd), which can print 45 sheets of A4 paper in a minute, and evaluated by following criteria. The results are shown in Tables 4 and 5.

TABLE 3

| | | Toner particle size | | | | | |
|---|---|---|---|---|---|---|---|
| | | Volume average particle diameter (μm) | Number average particle diameter (μm) | Dv/Dn | Fine particle abundance ratio (% by weight) | Charge quantity (μC/g) | Coverage by coat (%) |
| Example 3 | Toner 4 | 6.20 | 5.70 | 1.09 | 0.5 | 28.0 | 43 |
| Example 4 | Toner 5 | 6.24 | 5.48 | 1.14 | 1.2 | 29.1 | |
| Example 5 | Toner 6 | 7.05 | 5.82 | 1.21 | 1.5 | 30.2 | |
| Example 6 | Toner 7 | 5.24 | 4.30 | 1.22 | 1 | 28.2 | |
| Example 7 | Toner 8 | 5.80 | 5.17 | 1.12 | 0.2 | 25.4 | 37 |
| Example 8 | Toner 9 | 6.32 | 5.29 | 1.19 | 2.5 | 31.4 | |
| Example 9 | Toner 10 | 7.05 | 5.72 | 1.23 | 2.0 | 30.8 | |
| Example 10 | Toner 11 | 4.80 | 3.90 | 1.23 | 0.3 | 25.2 | |
| Example 11 | Toner 12 | 6.21 | 5.30 | 1.17 | 3.5 | 28.1 | 83 |
| Example 12 | Toner 13 | 6.19 | 5.69 | 1.09 | 0.5 | 19.8 | |
| Comparative example 2 | Toner 14 | 6.52 | 5.31 | 1.23 | — | 26.8 | |
| Comparative example 3 | Toner 15 | 6.40 | 5.30 | 1.21 | — | 24.1 | |
| Comparative example 4 | Toner 16 | 15.34 | 10.39 | 1.48 | 0.0 | 12.5 | 0 |

TABLE 4

| | | Image density | | | Scumming (23° C., 50% RH) | | | Scumming (27° C., 80% RH) | | |
|---|---|---|---|---|---|---|---|---|---|---|
| | | Start | After printing 10,000 sheets | After printing 100,000 sheets | Start | After printing 10,000 sheets | After printing 100,000 sheets | Start | After printing 10,000 sheets | After printing 100,000 sheets |
| Example 3 | Toner 4 | 1.39 | 1.40 | 1.41 | 0.00 | 0.00 | 0.01 | 0.01 | 0.02 | 0.05 |
| Example 4 | Toner 5 | 1.37 | 1.40 | 1.39 | 0.00 | 0.00 | 0.00 | 0.00 | 0.01 | 0.03 |
| Example 5 | Toner 6 | 1.41 | 1.41 | 1.40 | 0.01 | 0.00 | 0.01 | 0.01 | 0.00 | 0.02 |
| Example 6 | Toner 7 | 1.41 | 1.42 | 1.41 | 0.00 | 0.01 | 0.00 | 0.00 | 0.06 | 0.06 |
| Example 7 | Toner 8 | 1.36 | 1.38 | 1.39 | 0.00 | 0.00 | 0.00 | 0.00 | 0.05 | 0.30 |
| Example 8 | Toner 9 | 1.37 | 1.39 | 1.38 | 0.01 | 0.00 | 0.01 | 0.00 | 0.01 | 0.02 |
| Example 9 | Toner 10 | 1.37 | 1.40 | 1.39 | 0.00 | 0.00 | 0.01 | 0.00 | 0.01 | 0.01 |
| Example 10 | Toner 11 | 1.40 | 1.42 | 1.43 | 0.01 | 0.01 | 0.00 | 0.01 | 0.24 | 0.32 |
| Example 11 | Toner 12 | 1.41 | — | — | 0.01 | — | — | 0.03 | — | — |
| Example 12 | Toner 13 | 1.39 | — | — | 0.28 | — | — | 0.48 | — | — |
| Comparative example 2 | Toner 14 | 1.36 | 1.44 | — | 0.02 | 0.41 | — | 0.05 | 0.62 | — |
| Comparative example 3 | Toner 15 | 1.38 | 1.45 | — | 0.01 | 0.36 | — | 0.03 | 0.45 | — |
| Comparative example 4 | Toner 16 | 1.37 | — | — | 0.30 | — | — | 0.35 | — | — |

TABLE 5

| | | Cleaning | | | Filming | Charge quantity | | | Fixing properties Lower limit of | |
|---|---|---|---|---|---|---|---|---|---|---|
| | | Start | After printing 10,000 sheets | After printing 100,000 sheets | After printing 100,000 sheets | Start | After printing 10,000 sheets | After printing 100,000 sheets | fixing temperature | Offset |
| Example 3 | Toner 4 | ○ | ○ | ○ | ○ | 31.9 | 30.2 | 30.4 | 140 | 220 |
| Example 4 | Toner 5 | ○ | ○ | ○ | ○ | 31.6 | 30.5 | 30.1 | 155 | 220 |
| Example 5 | Toner 6 | ○ | ○ | ○ | ○ | 32.6 | 30.4 | 31.2 | 160 | 220 |
| Example 6 | Toner 7 | ○ | ○ | ○ | ○ | 32.8 | 30.5 | 30.4 | 145 | 220 |
| Example 7 | Toner 8 | ○ | ○ | ○ | ○ | 30.5 | 30.6 | 31.2 | 140 | 220 |
| Example 8 | Toner 9 | ○ | ○ | ○ | ○ | 30.6 | 33.6 | 30.1 | 175 | 220 |
| Example 9 | Toner 10 | ○ | ○ | ○ | ○ | 34.2 | 33.2 | 29.9 | 170 | 220 |
| Example 10 | Toner 11 | ○ | ○ | ○ | ○ | 32.6 | 31.5 | 32.7 | 140 | 220 |
| Example 11 | Toner 12 | ○ | — | — | — | 32.6 | — | — | 210 | 220 |
| Example 12 | Toner 13 | ○ | — | — | — | 20.2 | — | — | 140 | 220 |
| Comparative example 2 | Toner 14 | ○ | ○ | — | — | 34.6 | 16.7 | — | 175 | 220 |
| Comparative example 3 | Toner 15 | ○ | ○ | — | — | 31.9 | 14.6 | — | 170 | 225 |
| Comparative example 4 | Toner 16 | x | — | — | — | 16.1 | — | — | 150 | 220 |

Toners 14 and 15 caused a trace quantity of fixing failure. The evaluation was ceased after printing 10,000 sheets, because the deterioration in scumming due to the decrease in charging made it impossible to carry out continuous printing.

The evaluation of toner 16 was ceased because the particle diameter thereof could not be controlled, and the toner caused bad scumming from the beginning.

Examples 13, 14 and Comparative Example 5

Figure 4:
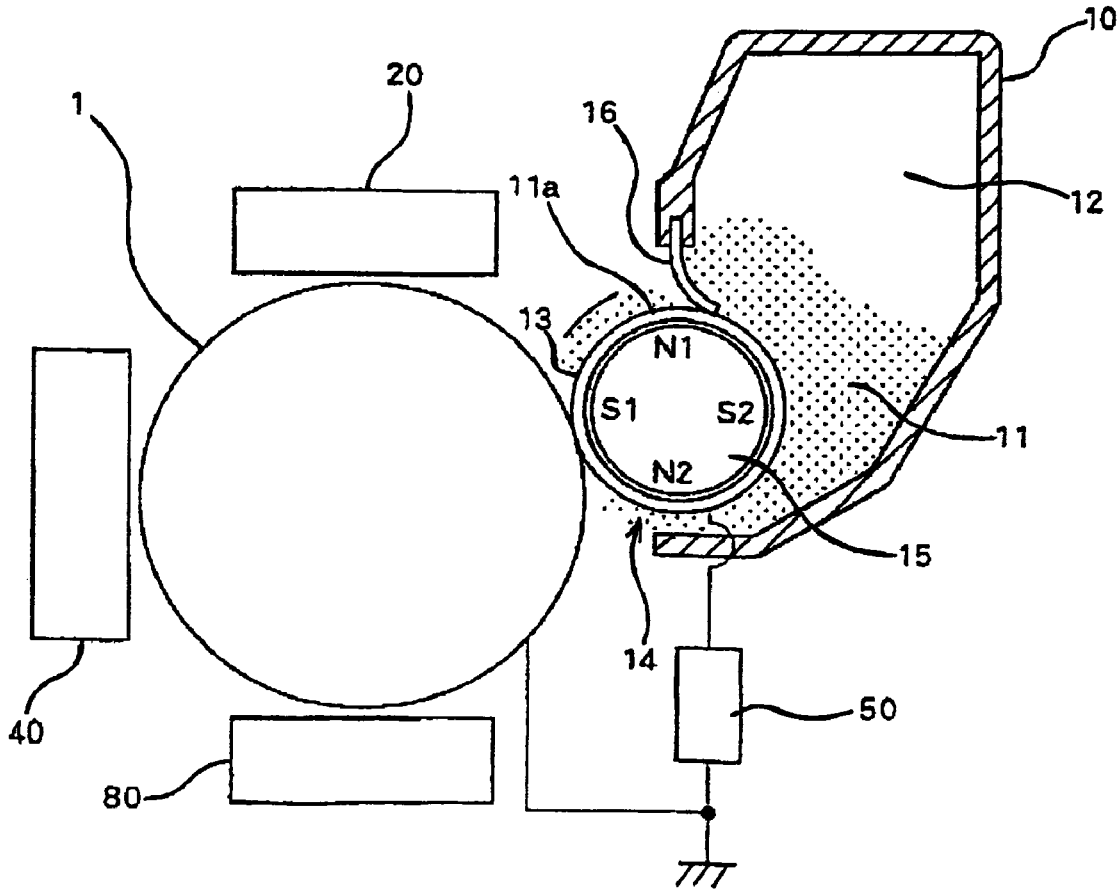
FIG. 4 is a schematic illustration of an image forming apparatus of the present invention.

As shown in FIG. 4, developing apparatus 10 is arranged to oppose to a drum-form electrophotographic photoconductor that is an image bearing member of the developing apparatus rotating in the direction pointed by the arrow, or photoconductor drum 1, and an electrostatic latent image is formed on this photoconductor drum 1 by a known electrostatic latent image forming apparatus 20 including a charger and exposure means or the like. As the exposure means, an optical system for scanning a laser beam modulated by the projection means for an optical image on a source document or by recorded image signals, and the like are used, and a latent image formed on the photoconductor drum 1 is developed by developing apparatus 10 to form a toner image.

The formed toner image is transferred to a transfer material such as paper by known transferring means 80 including a transfer charger. The transfer material that received the toner image was separated from the photoconductor drum 1 and sent to a known fixing means (not shown), where the toner image is fixed to the transfer material.

The toner remained on photoconductor drum 1 after transfer has completed is removed by known cleaning means 40 using a cleaning blade. The cleaning blade is fixed to a blade holder made of steel plate at a hardness of about 65° (JISA), and contacts with photoconductor drum 1 with an invasion amount of 0.5 to 1 mm.

Developing apparatus 10 includes developer container 12 containing insulating one-component developer 11 containing no carrier particle. Developer 11 is mainly comprised of an insulating toner, and preferably a certain amount of silica fine powder is externally added. Silica fine powder is externally added for the purpose of controlling the frictional charge of the toner to increase the image density and form an image with less roughness. For example, known is to externally add silica prepared by a gas phase process (dry silica) and/or those prepared by a wet process (wet silica) to a toner.

The one-component developer, or toner 11 is taken out from container 12 by nonmagnetic developing roller 14 that is a developer support rotating in the direction pointed by the arrow and made of aluminum, stainless steel or the like, and transferred to developing region 13 opposed to photoconductor drum 1. In developing region 13, photoconductor drum 1 and developing roller 14 are arranged to oppose to each other leaving an infinitesimal gap of 300 μm between them, but an infinitesimal gap of desired distance was made in the experiment described below. In developing region 13, toner 11 is transferred and attached to an electrostatic latent image on photoconductor drum 1, and the electrostatic latent image is developed as a toner image. When a magnetic toner is used, a magnet may be arranged inside the developing roller.

The frictional charging member arranged ahead of developing 13 to which toner is transferred is described as follows: the thickness of developing agent layer 11*a* on developing roller 14 is controlled by elastic blade 16. Elastic blade 16 is made of an elastic body such as urethane rubber, has a thickness of 1 to 1.5 mm and a free length of about 10 mm, fixed to a holder made of steel plate with a contact pressure of about 30 g/cm, and comes into contact with the top of developing roller 14. Blade 16 forms a thin developer layer 11*a* on developing roller 14. The frictional charging member is not necessarily limited to the elastic blade, and may be an elastic roller that can form an equivalent contact pressure.

As described above, the developing apparatus shown in FIG. 4 carries out non-contact developing. In other words, the thickness of toner layer 11*a* transferred to developing region 13 is smaller than the infinitesimal gap between developing roller 14 and photoconductor drum 1, thus toner 11 is sent from developing roller 14, flies over the air gap to reach photoconductor drum 1. At the time, a developing bias voltage containing an alternating current component is applied to developing roller 14 by bias power source 50 for improving the developing efficiency to form a developed image with high density, sharpness and reduced scumming.

In Example 13, 14 and Comparative example 5, when a latent image having a dark part potential of −700 V and a light part potential of −150 V was developed by a reversal process with a negatively charged toner, a rectangular wave voltage composed of an direct current element of −550 V, the peak-to-peak voltage of an alternating current element of 1.0 kV, and a frequency of 3.0 kHz was used as a developing bias voltage.

The bias voltage applies to toner 11 alternately an electric field in the direction that transfers toner 11 from developing roller 14 to photoconductor drum 1, and an electric field in the direction that reversely transfers toner 11 from photoconductor drum 1 to developing roller 14. This produces a good developing image.

Toners 1 to 3 were evaluated using the above-mentioned apparatus, and the results are shown in Table 6.

TABLE 6

| | | Frictional charge quantity (μC/g) | | | Scumming | | |
|---|---|---|---|---|---|---|---|
| | | Start | After printing 10,000 sheets | After printing 100,000 sheets | Start | After printing 10,000 sheets | After printing 100,000 sheets |
| Example 13 | Toner 1 | 18.2 | 18.5 | 18.5 | 0.00 | 0.01 | 0.01 |
| Example 14 | Toner 2 | 16.0 | 17.1 | 16.4 | 0.02 | 0.04 | 0.05 |
| Comparative example 5 | Toner 3 | 15.7 | 16.3 | 15.9 | 0.06 | 0.66 | 0.79 |

The toners in Tables 1 to 6 were evaluated as described below.

(Evaluation Items)

(a) Particle Diameter

The particle diameter of the toners was measured using a Coulter Counter TA II that is a particle diameter measuring apparatus manufactured by Coulter Electronics Co., Ltd., at an aperture diameter of 100 μm. The volume average particle diameter and number average particle diameter were determined by the above-mentioned particle diameter measuring apparatus.

(b) Charge Quantity 6 g of the developer was weighed, put in a sealable metal cylinder, and blown to determine the charge quantity thereof. The toner concentration was adjusted to 4.5 to 5.5% by weight.

(c) Fixing Properties

An imagio Neo 450 (manufactured by Ricoh Co., Ltd) was adjusted so that a toner was developed at 1.0±0.1 mg/cm$^2$ in a solid image on transfer sheets of plain paper and cardboard (Type 6200 manufactured by Ricoh Co., Ltd. and Copy Printing Paper <135> manufactured by NBS Ricoh Co., Ltd., respectively), and the temperature of the fixing belt was adjusted to be variable for measuring the temperature that caused no offset on the plain paper and the lower limit of fixing temperature on the cardboard. When the image density of the fixed image remained 70% or higher after being rubbed with a pat, the temperature of the fixing roll was regarded as the lower limit of fixing temperature.

(d) Circularity

Average circularity was measured using a flow system particle image analyzer FPIA-1000 (manufactured by To a Medical Electron Co., Ltd.). Specifically, to 100 to 150 ml of water in a container, which has been previously cleaned of impurities, 0.1 to 0.5 ml of a surfactant, preferably alkylbenzene sulfonate, is added as a dispersing agent, and 0.1 to 0.5 g of a test sample is further added. The suspension in which the sample has been dispersed was subjected to a dispersion treatment for about one to three minutes using an ultrasonic dispersing apparatus to make the concentration of the dispersion 3,000 to 10,000 particles/I, and be measured for the shape and distribution of the toner using the apparatus.

(e) Method for Measuring Residual Ratio of Resin Fine Particles

Using styrene monomer, which is a pyrolysate of styrene acrylic resin fine particles in a toner, the resin fine particles unevenly distributed on the toner surface were determined by calculating from the peak area of the styrene monomer, using a standard addition method in which the styrene acrylic resin fine particles were added to the toner particles at concentrations of 0.01% by weight, 0.10% by weight, 1.00% by weight, 3.00% by weight and 10.00% by weight under the following conditions:

Analyzing apparatus: Pyrolysis gas chromatograph (mass spectrometer)

Apparatus: QR-5000 manufactured by Shimadzu Corp., JHP-3S manufactured by Nippon Bunseki Kogyo K.K.

Thermal decomposition temperature; 590° C.×12 seconds

Column; DB-1 L=30 m

I.D=0.25 mm

Film=0.25 μm

Column temperature; 40° C. (kept for 2 minutes)–(temperature rise 10° C./minute) 300° C.

Vaporization room temperature; 300° C.

All the items were evaluated as described below after continuously running the image chart of 5% image area up to 50,000 sheets.

(f) Image Density

After outputting solid images, the image densities were measured using X-Rite (manufactured by X-Rite Incorporated). The measurements were carried out at five points of each color, and the average was calculated for each color.

(g) Scumming

A white image was stopped during developing, the developer on the developed photoconductor was transferred to a tape, and the difference of the image density between the tape and untransferred tape was measured using a 938 Spectrodensitometer (manufactured by X-Rite Incorporated).

(h) Cleanability

The residual toner on a photoconductor that had passed through a cleaning process was transferred to a white paper using a Scotch tape (manufactured by Sumitomo 3M Ltd.), and density thereof was measured using a Macbeth reflection densitometer RD 514. When the difference of the density between the blank and a sample was 0.01 or lower, the sample was evaluated as ○ (good), and when the difference exceeded 0.01, the sample was evaluated as x (failure).

(i) Filming

The presence or absence of the occurrence of toner filming on a developing roller or photoconductor was observed. Symbol ○ represents no filming, Δ represents streaky filming, and x represents overall filming.

The present invention provides a toner for developing an electrostatic charge image which is good in the initial printing quality, excellent in the stability of image quality in continuous printing, has stable electrification less susceptible to environmental conditions of atmospheric temperature and moisture in the air, stable cleanability, and excellent in the low-temperature fixing property without causing filming over photoconductors, developing rollers and the like.

The present invention also provides a developer containing the toner, an image forming process using the toner, a container containing the toner, and an image forming apparatus equipped with the toner.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner for developing an electrostatic image comprising:

toner particles, and a charge control agent, wherein an abundance of the charge control agent on a surface of the toner is higher than that in an inside of the toner;

wherein a volume average particle diameter of the toner particles is 2.0 μm to 7.1 μm and the surface condition of the toner is in scab form, wherein a part of the surface of the toner is covered with a coat in scab form and wherein the coverage ratio by the coat in scab form is 1% to 90%; and wherein the toner comprises a toner binder resin, and the main component of the toner binder resin is polyester resin.

2. A toner for developing an electrostatic imageaccording to claim 1, wherein the coverage ratio by the coat in scab form is 5% to 80%.

3. A toner for developing an electrostatic image according to claim 1, wherein the weight ratio of the coat in scab form to the toner is 0.5% by weight to 4.0% by weight.

4. A toner for developing an electrostatic image according to claim 3, wherein the weight ratio of the coat in scab form to the toner is 0.5% by weight to 3.0% by weight.

5. A toner for developing an electrostatic image according to claim 1, wherein the surface condition of the toner in scab form is formed with resin fine particles.

6. A toner for developing an electrostatic image according to claim 5, wherein the average particle diameter of the resin fine particles is 5 nm to 2,000 nm.

7. A toner for developing an electrostatic image according to claim 5, wherein the resin particle comprises at least one resin selected from the group consisting of vinyl resin, polyurethane resin, epoxy resin, and polyester resin.

8. A toner for developing an electrostatic image according to claim 1, wherein the charge control agent is externally added to the surface of toner particles.

9. A toner for developing an electrostatic image according to claim 8, wherein the external addition of a charge control agent particle to the surface of the toner particles is carried out by mixing them in a container with a smooth inner surface, and wherein a peripheral speed of a rotor in the container is 40 m/sec to 150 m/sec.

10. A toner for developing an electrostatic image according to claim 9, wherein the container with a smooth inner surface is nearly spherical, and the volume of the rotor in the container is half or smaller than the capacity of the container.

11. A toner for developing an electrostatic image according to claim 8, wherein the amount of the charge control agent is 0.01% by weight to 2% by weight of the amount of the toner particles.

12. A toner for developing an electrostatic image according to claim 1, which is prepared by dissolving or dispersing a toner composition which comprises a toner binder resin composed of a modified polyester-base resin (i) capable of reacting with active hydrogen in an organic solvent, allowing the dissolved or dispersed toner composition to react with at least one of a crosslinking agent and an elongation agent in an aqueous medium containing resin fine particles, removing a solvent from the dispersion, and washing and separating the resin fine particles from the toner surface.

13. A toner for developing an electrostatic image according to claim 12, wherein the process of removing a solvent from the dispersion is conducted under at least one of a reduced-pressure and heated condition.

14. A toner for developing an electrostatic image according to claim 12, wherein the process of removing a solvent from the dispersion is carried out by filtration.

15. A toner for developing an electrostatic image according to claim 1, wherein the toner binder resin comprises an unmodified polyester-base resin (LL) in addition to a modified polyester-base resin (i), and the weight ratio of the modified polyester-base resin (i) to the unmodified polyester-base resin (LL) is 5/95 to 80/20.

16. A toner for developing an electrostatic image according to claim 1, wherein the acid value of the toner binder resin is 1 mg KOH/g to 30 mg KOH/g.

17. A toner for developing an electrostatic image according to claim 1, wherein the glass transition temperature of the toner binder resin is 40° C. to 70° C.

18. A toner for developing an electrostatic image according to claim 1, wherein the ratio of the volume average particle diameter Dv to the number average particle diameter Dn of the toner particle, that is Dv/Dn, is 1.25 or lower.

19. A toner for developing an electrostatic image according to claim 1, wherein the average circularity of the toner particle is 0.94 to 1.00.

20. A toner for developing an electrostatic image according to claim 19, wherein the average circularity of the toner particle is 0.94 to 0.96.

21. A toner for developing an electrostatic image comprising toner particles, and a charge control agent, wherein a volume average particle diameter of the toner particles is 2.0 μm to 7.1 μm, and the ratio of the number of small projections on the toner surface to the average circularity of the toner is 1.0 to 25.0, wherein the abundance of the charge control agent on the surface of the toner is higher than that in the inside of the toner; and wherein the amount of the charge control agent is 0.01% by weight to 2% by weight of the amount of the toner particles.

22. A toner for developing an electrostatic image according to claim 21, wherein the small projections comprise resin fine particles.

23. A toner for developing an electrostatic image according to claim 22, wherein an average particle diameter of the resin particle is 5 nm to 2,000 nm.

24. A toner for developing an electrostatic image according to claim 22, wherein the resin particle comprises at least one resin selected from the group consisting of vinyl resin, polyurethane resin, epoxy resin, and polyester resin.

25. A toner for developing an electrostatic image according to claim 21, wherein the charge control agent is externally added to the surface of the toner particles.

26. A toner for developing an electrostatic image according to claim 25, wherein the external addition of a charge control agent particle to the surface of the toner particles is carried out by mixing them in a container with a smooth inner surface, and wherein a peripheral speed of a rotor in the container is 40 m/sec to 150 m/sec.

27. A toner for developing an electrostatic image according to claim 26, wherein the container with a smooth inner surface is nearly spherical, and the volume of the rotor in the container is half or smaller than the capacity of the container.

28. A toner for developing an electrostatic image according to claim 21, further comprising a toner binder resin, wherein the main component of the toner binder resin of the toner is polyester resin.

29. A toner for developing an electrostatic image according to claim 28, which is prepared by dissolving or dispersing a toner composition which comprises a toner binder resin composed of a modified polyester-base resin (i) capable of reacting with active hydrogen in an organic solvent, allowing the dissolved or dispersed toner composition to react with at least one of a crosslinking agent and an elongation agent in an aqueous medium containing resin fine particles, removing a solvent from the dispersion, and washing and separating the resin fine particles from the toner surface.

30. A toner for developing an electrostatic image according to claim 29, wherein the process of removing a solvent from the dispersion is conducted under at least one of a reduced-pressure and heated condition.

31. A toner for developing an electrostatic image according to claim 29, wherein the process of removing a solvent from the dispersion is carried out by filtration.

32. A toner for developing an electrostatic image according to claim 28, wherein the toner binder resin comprises an unmodified polyester-base resin (LL) in addition to a modified polyester-base resin (i), and the weight ratio of the modified polyester-base resin (i) to the unmodified polyester-base resin (LL) is 5/95 to 80/20.

33. A toner for developing an electrostatic image according to claim 28, wherein the acid value of the toner binder resin is 1 mg KOH/g to 30 mg KOH/g.

34. A toner for developing an electrostatic image according to claim 28, wherein the glass transition temperature of the toner binder resin is 40° C. to 70° C.

35. A toner for developing an electrostatic image according to claim 21, wherein the ratio of the volume average particle diameter Dv to a number average particle diameter Dn of the toner particle, that is Dv/Dn, is 1.25 or lower.

36. A toner for developing an electrostatic image according to claim 21, wherein the average circularity of the toner particle is 0.94 to 1.00.

37. A toner for developing an electrostatic image according to claim 36, wherein the average circularity of the toner particle is 0.94 to 0.96.

38. A developer comprising a toner for developing an electrostatic image, wherein the toner for developing an electrostatic image comprises toner particles, and a charge control agent, wherein an abundance of the charge control agent on a surface of the toner is higher than that in an inside of the toner;

wherein a volume average particle diameter of the toner particles is 2.0 μm to 7.1 μm and the surface condition of the toner is in scab form, wherein a part of the surface of the toner is covered with a coat in scab form and wherein the coverage ratio by the coat in scab form is 1% to 90%; and wherein the toner comprises a toner binder resin, and the main component of the toner binder resin is polyester resin.

39. An image forming method, comprising:

developing an electrostatic image with a toner in a developing apparatus equipped with a toner recycling mechanism, said toner for developing the electrostatic image comprising:

toner particles, and a charge control agent, wherein an abundance of the charge control agent on a surface of the toner is higher than that in an inside of the toner;

wherein a volume average particle diameter of the toner particles is 2.0 μm to 7.1 μm and the surface condition of the toner is in scab form, wherein a part of the surface of the toner is covered with a coat in scab form and wherein the coverage ratio by the coat in scab form is 1% to 90%; and wherein the toner comprises a toner binder resin, and the main component of the toner binder resin is polyester resin.

40. A toner container which contains a toner for developing an electrostatic image, wherein the toner for developing an electrostatic image comprises toner particles, and a charge control agent, wherein an abundance of the charge control agent on a surface of the toner is higher than that in an inside of the toner;

wherein a volume average particle diameter of the toner particles is 2.0 μm to 7.1 μm and the surface condition of the toner is in scab form, wherein a part of the surface of the toner is covered with a coat in scab form and wherein the coverage ratio by the coat in scab form is 1% to 90%; and wherein the toner comprises a toner binder resin, and the main component of the toner binder resin is polyester resin.

41. A developer, comprising:

a toner for developing an electrostatic image, and a charge control agent, wherein the toner for developing an electrostatic image comprises toner particles, and wherein a volume average particle diameter of the toner particles is 2.0 μm to 7.1 μm, and the ratio of the number of small projections on the toner surface to the average circularity of the toner is 1.0 to 25.0, wherein the abundance of the charge control agent on the surface of the toner is higher than that in the inside of the toner; and wherein the amount of the charge control agent is 0.01% by weight to 2% by weight of the amount of the toner particles.

42. A toner container which contains a toner for developing an electrostatic image, and a charge control agent, wherein the toner for developing an electrostatic image comprises toner particles, and wherein a volume average particle diameter of the toner particles is 2.0 μm to 7.1 μm, and the ratio of the number of small projections on the toner surface to the average circularity of the toner is 1.0 to 25.0, wherein the abundance of the charge control agent on the surface of the toner is higher than that in the inside of the toner; and wherein the amount of the charge control agent is 0.01% by weight to 2% by weight of the amount of the toner particles.

* * * * *